US011154877B2

(12) United States Patent
Walker et al.

(10) Patent No.: US 11,154,877 B2
(45) Date of Patent: Oct. 26, 2021

(54) ROTARY STRIP NOZZLES

(71) Applicant: Rain Bird Corporation, Azusa, CA (US)

(72) Inventors: Samuel C. Walker, Green Valley, AZ (US); David Charles Belongia, Quail Creek, AZ (US); Jason Addink, Gilbert, AZ (US); Andrew P. Miller, Gilbert, AZ (US)

(73) Assignee: Rain Bird Corporation, Azusa, CA (US)

( * ) Notice: Subject to any disclaimer, the term of this patent is extended or adjusted under 35 U.S.C. 154(b) by 429 days.

(21) Appl. No.: 15/473,036

(22) Filed: Mar. 29, 2017

(65) Prior Publication Data

US 2018/0280994 A1 Oct. 4, 2018

(51) Int. Cl.

| | |
|---|---|
| ***B05B 1/16*** | (2006.01) |
| ***B05B 3/02*** | (2006.01) |
| ***B05B 1/26*** | (2006.01) |
| ***B05B 3/04*** | (2006.01) |
| ***B05B 1/30*** | (2006.01) |

(52) U.S. Cl.

CPC ..... *B05B 1/1654* (2013.01); *B05B 1/169* (2013.01); *B05B 1/267* (2013.01); *B05B 1/304* (2013.01); *B05B 3/021* (2013.01); *B05B 3/0486* (2013.01)

(58) Field of Classification Search

CPC ..... B05B 1/169; B05B 1/304; B05B 3/0486; B05B 1/267; B05B 3/021; B05B 1/1654

See application file for complete search history.

(56) References Cited

U.S. PATENT DOCUMENTS

| | | | |
|---|---|---|---|
| 458,607 | A | 9/1891 | Weiss |
| 581,252 | A | 4/1897 | Quayle |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

European Patent Office, Extended European Search Report for European Application No. 18164557.3 dated Aug. 29, 2018 (8 pages).

(Continued)

*Primary Examiner* — Steven M Cernoch

(74) *Attorney, Agent, or Firm* — Fitch, Even, Tabin & Flannery LLP

(57) ABSTRACT

A specialty nozzle is provided having a pattern adjustment valve that may be adjusted to irrigate a substantially rectangular irrigation area. The nozzle may be further adjusted to irrigate three different substantially rectangular irrigation areas. The nozzle is adjustable to function as a left strip nozzle, right strip nozzle, and side strip nozzle. The strip irrigation setting may be selected by pressing down and rotating a deflector to directly actuate the valve. The nozzle may also include a flow reduction valve to set the size of the rectangular irrigation areas and may be adjusted by actuation of an outer wall of the nozzle. Other specialty nozzles are provided having a fixed pattern template to irrigate a rectangular area, such as left strip, right strip, or side strip.

10 Claims, 29 Drawing Sheets

(56) References Cited

U.S. PATENT DOCUMENTS 598,873 A 2/1898 Joy
1,286,333 A 12/1918 Johnson
1,432,386 A 10/1922 Ctjkwey
1,523,609 A 1/1925 Roach
1,964,225 A 6/1934 Sumner
2,025,063 A 12/1935 Loepsinger
2,075,589 A 3/1937 Munz
2,125,863 A 8/1938 Arbogast
2,125,978 A 8/1938 Arbogast
2,128,552 A 8/1938 Rader
2,130,810 A 9/1938 Munz
2,135,138 A 11/1938 Kendall
2,325,280 A 7/1943 Scherrer
2,348,776 A 5/1944 Bentley
2,515,598 A 7/1950 Hansen
2,634,163 A 4/1953 Double
2,723,879 A 11/1955 Martin
2,785,013 A 3/1957 Stearns
2,875,783 A 3/1959 Schippers
2,914,257 A 11/1959 Wiant
2,935,266 A 5/1960 Coleondro
2,990,123 A 6/1961 Hyde
2,990,128 A 6/1961 Knutsen
3,029,030 A 4/1962 Dey, Sr.
3,030,032 A 4/1962 Juhman, Jr.
3,109,591 A 11/1963 Moen
3,239,149 A 3/1966 Lindberg, Jr.
3,380,659 A 4/1968 Seablom
3,424,381 A 1/1969 Best
3,528,093 A 9/1970 Eerkens
3,752,403 A 8/1973 Diest
3,854,664 A 12/1974 Hunter
3,955,764 A 5/1976 Phaup
4,026,471 A 5/1977 Hunter
4,099,675 A 7/1978 Wohler
4,119,275 A 10/1978 Hunter
4,131,234 A 12/1978 Pescetto
4,180,210 A 12/1979 DeWitt
4,189,099 A 2/1980 Bruninga
4,198,000 A 4/1980 Hunter
4,235,379 A 11/1980 Beamer
4,253,608 A 3/1981 Hunter
4,261,515 A 4/1981 Rosenberg
4,269,354 A 5/1981 DeWitt
4,272,024 A 6/1981 Kah
4,281,793 A 8/1981 DeWitt
4,316,579 A 2/1982 Ray
4,353,506 A 10/1982 Hayes
4,353,507 A 10/1982 Kah
4,398,666 A 8/1983 Hunter
4,417,691 A 11/1983 Lockwood
4,456,181 A 6/1984 Burnham
4,471,908 A 9/1984 Hunter
4,479,611 A 10/1984 Galvis
4,501,391 A 2/1985 Hunter
4,512,519 A 4/1985 Uzrad
4,540,125 A 9/1985 Gorney
4,566,632 A 1/1986 Sesser
4,568,024 A 2/1986 Hunter
4,579,284 A 4/1986 Arnold
4,579,285 A 4/1986 Hunter
4,609,146 A 9/1986 Walto
4,618,100 A 10/1986 White
4,624,412 A 11/1986 Hunter
4,625,917 A 12/1986 Torney
4,632,312 A 12/1986 Premo
RE32,386 E 3/1987 Hunter
4,660,766 A 4/1987 Nelson
4,669,663 A 6/1987 Meyer
4,676,438 A 6/1987 Sesser
4,681,260 A 7/1987 Cochran
4,681,263 A 7/1987 Cockman
4,682,732 A 7/1987 Walto
4,699,321 A 10/1987 Bivens
4,708,291 A 11/1987 Grundy
4,711,399 A 12/1987 Rosenberg
4,718,605 A 1/1988 Hunter
4,720,045 A 1/1988 Meyer
4,728,040 A 3/1988 Healy
4,739,394 A 4/1988 Oda
4,739,934 A 4/1988 Gewelber
D296,464 S 6/1988 Marmol
4,752,031 A 6/1988 Merrick
4,754,925 A 7/1988 Rubinstein
4,760,958 A 8/1988 Greenberg
4,763,838 A 8/1988 Holcomb
4,783,004 A 11/1988 Lockwood
4,784,325 A 11/1988 Walker
4,796,809 A 1/1989 Hunter
4,796,811 A 1/1989 Davisson
4,815,662 A 3/1989 Hunter
4,817,869 A 4/1989 Rubinstein
4,832,264 A 5/1989 Rosenberg
4,834,289 A 5/1989 Hunter
4,836,449 A 6/1989 Hunter
4,836,450 A 6/1989 Hunter
4,840,312 A 6/1989 Tyler
4,842,201 A 6/1989 Hunter
4,867,378 A 9/1989 Kah
4,867,379 A 9/1989 Hunter
4,898,332 A 2/1990 Hunter
4,901,924 A 2/1990 Kah
4,932,590 A 6/1990 Hunter
4,944,456 A 7/1990 Zakai
4,948,052 A 8/1990 Hunter
4,955,542 A 9/1990 Kah
4,957,240 A 9/1990 Rosenberg
4,961,534 A 10/1990 Tyler
4,967,961 A 11/1990 Hunter
4,971,250 A 11/1990 Hunter
D312,865 S 12/1990 Davisson
4,986,474 A 1/1991 Schisler
5,031,840 A 7/1991 Grundy
5,050,800 A 9/1991 Lamar
5,052,621 A 10/1991 Katzer
5,058,806 A 10/1991 Rupar
5,078,321 A 1/1992 Davis
5,083,709 A 1/1992 Iwanowski
RE33,823 E 2/1992 Nelson
5,086,977 A 2/1992 Kah
5,090,619 A 2/1992 Barthold
5,098,021 A 3/1992 Kah
5,104,045 A 4/1992 Kah
5,123,597 A 6/1992 Bendall
5,141,024 A 8/1992 Hicks
5,143,657 A 9/1992 Curtis
5,148,990 A 9/1992 Kah
5,148,991 A 9/1992 Kah
5,152,458 A 10/1992 Curtis
5,158,232 A 10/1992 Tyler
5,174,501 A 12/1992 Hadar
5,199,646 A 4/1993 Kah
5,205,491 A 4/1993 Hadar
5,224,653 A 7/1993 Nelson
5,226,599 A 7/1993 Lindermeir
5,226,602 A 7/1993 Cochran
5,234,169 A 8/1993 McKenzie
5,240,182 A 8/1993 Lemme
5,240,184 A 8/1993 Lawson
5,267,689 A 12/1993 Forer
5,288,022 A 2/1994 Sesser
5,299,742 A 4/1994 Han
5,322,223 A 6/1994 Hadar
5,335,857 A 8/1994 Hagon
5,360,167 A 11/1994 Grundy
5,370,311 A 12/1994 Chen
5,372,307 A 12/1994 Sesser
5,375,768 A 12/1994 Clark
5,381,960 A 1/1995 Sullivan
5,398,872 A 3/1995 Joubran
5,415,348 A 5/1995 Nelson
5,417,370 A 5/1995 Kah
5,423,486 A 6/1995 Hunter
5,435,490 A 7/1995 Machut

(56) References Cited

U.S. PATENT DOCUMENTS 5,439,174 A 8/1995 Sweet
RE35,037 E 9/1995 Kah
5,456,411 A 10/1995 Scott
5,503,139 A 4/1996 McMahon
5,526,982 A 6/1996 McKenzie
5,544,814 A 8/1996 Spenser
5,556,036 A 9/1996 Chase
5,588,594 A 12/1996 Kah
5,588,595 A 12/1996 Sweet
5,598,977 A 2/1997 Lemme
5,611,488 A 3/1997 Frolich
5,620,141 A 4/1997 Chiang
5,640,983 A 6/1997 Sherman
5,642,861 A 7/1997 Ogi
5,653,390 A 8/1997 Kah
5,662,545 A 9/1997 Zimmerman
5,669,449 A 9/1997 Polan
5,671,885 A 9/1997 Davisson
5,671,886 A 9/1997 Sesser
5,676,315 A 10/1997 Han
D388,502 S 12/1997 Kah
5,695,123 A 12/1997 Van Le
5,699,962 A 12/1997 Scott
5,711,486 A 1/1998 Clark
5,718,381 A 2/1998 Katzer
5,720,435 A 2/1998 Hunter
5,722,593 A 3/1998 McKenzie
5,746,374 A * 5/1998 Simonetti ..... B05B 1/1645 239/240
5,758,827 A 6/1998 Van Le
5,762,269 A 6/1998 Sweet
5,762,270 A 6/1998 Kearby
5,765,757 A 6/1998 Bendall
5,765,760 A 6/1998 Kuo
5,769,322 A 6/1998 Smith
5,785,248 A 7/1998 Staylor
5,820,029 A 10/1998 Marans
5,823,439 A 10/1998 Hunter
5,823,440 A 10/1998 Clark
5,826,797 A 10/1998 Kah
5,845,849 A 12/1998 Mitzlaff
5,875,969 A 3/1999 Grundy
5,918,812 A 7/1999 Beutler
5,927,607 A 7/1999 Scott
5,971,297 A 10/1999 Sesser
5,988,523 A 11/1999 Scott
5,992,760 A 11/1999 Kearby
6,007,001 A 12/1999 Hilton
6,019,295 A 2/2000 McKenzie
6,029,907 A 2/2000 McKenzie
6,042,021 A 3/2000 Clark
6,050,502 A 4/2000 Clark
6,059,044 A 5/2000 Fischer
6,076,744 A 6/2000 O'Brien
6,076,747 A 6/2000 Ming-Yuan
6,085,995 A 7/2000 Kah
6,092,739 A 7/2000 Clearman
6,102,308 A 8/2000 Steingass
6,109,545 A 8/2000 Kah
6,123,272 A 9/2000 Havican
6,138,924 A 10/2000 Hunter
6,145,758 A 11/2000 Ogi
6,155,493 A 12/2000 Kearby
6,158,675 A 12/2000 Ogi
6,182,909 B1 2/2001 Kah
6,186,413 B1 2/2001 Lawson
6,223,999 B1 5/2001 Lemelshtrich
6,227,455 B1 5/2001 Scott
6,230,988 B1 5/2001 Chao
6,230,989 B1 5/2001 Haverstraw
6,234,411 B1 5/2001 Walker
6,237,862 B1 5/2001 Kah
6,241,158 B1 6/2001 Clark
6,244,521 B1 6/2001 Sesser
6,254,013 B1 7/2001 Clearman
6,264,117 B1 7/2001 Roman
6,267,299 B1 7/2001 Meyer
6,276,460 B1 8/2001 Pahila
6,286,767 B1 9/2001 Hui-Chen
6,332,581 B1 12/2001 Chin
6,336,597 B1 1/2002 Kah
6,341,733 B1 1/2002 Sweet
6,345,541 B1 2/2002 Hendey
6,367,708 B1 4/2002 Olson
D458,342 S 6/2002 Johnson
6,435,427 B1 8/2002 Conroy
6,439,477 B1 8/2002 Sweet
6,443,372 B1 9/2002 Hsu
6,454,186 B2 9/2002 Haverstraw
6,457,656 B1 10/2002 Scott
6,464,151 B1 10/2002 Cordua
6,478,237 B2 11/2002 Kearby
6,481,644 B1 11/2002 Olsen
6,488,218 B1 12/2002 Townsend
6,491,235 B1 12/2002 Scott
6,494,384 B1 12/2002 Meyer
6,499,672 B1 12/2002 Sesser
6,516,893 B2 2/2003 Pahila
6,530,531 B2 3/2003 Butler
6,601,781 B2 8/2003 Kah
6,607,147 B2 8/2003 Schneider
6,622,940 B2 9/2003 Huang
6,637,672 B2 10/2003 Cordua
6,651,904 B2 11/2003 Roman
6,651,905 B2 11/2003 Sesser
6,688,539 B2 2/2004 Vander Griend
6,695,223 B2 2/2004 Beutler
6,715,699 B1 4/2004 Greenberg
6,719,218 B2 4/2004 Cool
6,732,952 B2 5/2004 Kah
6,736,332 B2 5/2004 Sesser
6,736,336 B2 5/2004 Wong
6,737,332 B1 5/2004 Fuselier
6,769,633 B1 8/2004 Huang
6,811,098 B2 11/2004 Drechsel
6,814,304 B2 11/2004 Onofrio
6,814,305 B2 11/2004 Townsend
6,817,543 B2 11/2004 Clark
6,820,825 B1 11/2004 Wang
6,827,291 B2 12/2004 Townsend
6,834,816 B2 12/2004 Kah
6,840,460 B2 1/2005 Clark
6,848,632 B2 2/2005 Clark
6,854,664 B2 2/2005 Smith
6,869,026 B2 3/2005 McKenzie
6,871,795 B2 3/2005 Anuskiewicz
6,880,768 B2 4/2005 Lau
6,883,727 B2 4/2005 De Los Santos
6,921,030 B2 7/2005 Renquist
6,942,164 B2 9/2005 Walker
6,945,471 B2 9/2005 McKenzie
6,957,782 B2 10/2005 Clark
6,976,543 B1 12/2005 Fischer
6,997,393 B1 2/2006 Angold
7,017,831 B2 3/2006 Santiago
7,017,837 B2 3/2006 Taketomi
7,028,920 B2 4/2006 Hekman
7,028,927 B2 4/2006 Mermet
7,032,836 B2 4/2006 Sesser
7,032,844 B2 4/2006 Cordua
7,040,553 B2 5/2006 Clark
7,044,403 B2 5/2006 Kah
7,070,122 B2 7/2006 Burcham
7,090,146 B1 8/2006 Ericksen
7,100,842 B2 9/2006 Meyer
7,104,472 B2 9/2006 Renquist
7,111,795 B2 9/2006 Thong
7,143,957 B2 12/2006 Nelson
7,143,962 B2 12/2006 Kah
7,152,814 B1 12/2006 Schapper
7,156,322 B1 1/2007 Heitzman
7,159,795 B2 1/2007 Sesser
7,168,634 B2 1/2007 Onofrio
7,232,081 B2 6/2007 Kah

(56) References Cited

U.S. PATENT DOCUMENTS

| | | | |
|---|---|---|---|
| 7,234,651 | B2 | 6/2007 | Mousavi |
| 7,240,860 | B2 | 7/2007 | Griend |
| 7,287,711 | B2 | 10/2007 | Crooks |
| 7,293,721 | B2 | 11/2007 | Roberts |
| 7,303,147 | B1 | 12/2007 | Danner |
| 7,303,153 | B2 | 12/2007 | Han |
| 7,322,533 | B2 | 1/2008 | Grizzle |
| 7,337,988 | B2 | 3/2008 | McCormick |
| 7,389,942 | B2 | 6/2008 | Kenyon |
| RE40,440 | E | 7/2008 | Sesser |
| 7,392,956 | B2 | 7/2008 | McKenzie |
| 7,395,977 | B2 | 7/2008 | Pinch |
| 7,429,005 | B2 | 9/2008 | Schapper |
| 7,478,526 | B2 | 1/2009 | McAfee |
| 7,533,833 | B2 | 5/2009 | Wang |
| 7,581,687 | B2 | 9/2009 | Feith |
| 7,584,904 | B2 | 9/2009 | Townsend |
| 7,584,906 | B2 | 9/2009 | Lev |
| 7,597,273 | B2 | 10/2009 | McAfee |
| 7,597,276 | B2 | 10/2009 | Hawkins |
| 7,607,588 | B2 | 10/2009 | Nobili |
| 7,611,077 | B2 | 11/2009 | Sesser |
| 7,621,467 | B1 | 11/2009 | Garcia |
| 7,624,935 | B2 | 12/2009 | Nelson |
| 7,654,474 | B2 | 2/2010 | Cordua |
| 7,686,235 | B2 | 3/2010 | Roberts |
| 7,686,236 | B2 | 3/2010 | Alexander |
| 7,703,706 | B2 | 4/2010 | Walker |
| D615,152 | S | 5/2010 | Kah |
| 7,717,361 | B2 | 5/2010 | Nelson |
| 7,766,259 | B2 | 8/2010 | Feith |
| D628,272 | S | 11/2010 | Kah |
| 7,828,229 | B2 | 11/2010 | Kah |
| 7,850,094 | B2 | 12/2010 | Richmond |
| 7,861,948 | B1 | 1/2011 | Crooks |
| D636,459 | S | 4/2011 | Kah |
| 7,926,746 | B2 | 4/2011 | Melton |
| 7,942,345 | B2 | 5/2011 | Sesser |
| 7,971,804 | B2 | 7/2011 | Roberts |
| 7,980,488 | B2 | 7/2011 | Townsend |
| RE42,596 | E | 8/2011 | Sesser |
| 7,988,071 | B2 | 8/2011 | Bredberg |
| 8,006,919 | B2 | 8/2011 | Renquist |
| 8,011,602 | B2 | 9/2011 | Coppersmith |
| 8,028,932 | B2 | 10/2011 | Sesser |
| 8,047,456 | B2 | 11/2011 | Kah |
| 8,056,829 | B2 | 11/2011 | Gregory |
| 8,074,897 | B2 | 12/2011 | Hunnicutt |
| 8,205,811 | B2 | 6/2012 | Cordua |
| 8,272,578 | B1 | 9/2012 | Clark |
| 8,272,583 | B2 | 9/2012 | Hunnicutt |
| 8,282,022 | B2 | 10/2012 | Porter |
| 8,328,117 | B2 | 12/2012 | Bredberg |
| 8,540,171 | B2 | 9/2013 | Renquist |
| 8,567,691 | B2 | 10/2013 | Townsend |
| 8,567,697 | B2 | 10/2013 | Bredberg |
| 8,567,699 | B2 | 10/2013 | Sesser |
| 8,602,325 | B2 | 12/2013 | Clark |
| 8,651,400 | B2 | 2/2014 | Walker |
| 8,672,242 | B2 | 3/2014 | Hunnicutt |
| 8,695,900 | B2 | 4/2014 | Hunnicutt |
| 8,783,582 | B2 | 7/2014 | Robertson |
| 8,789,768 | B2 | 7/2014 | Hunnicutt |
| 8,893,986 | B2 | 11/2014 | Kah, Jr. |
| 8,925,837 | B2 | 1/2015 | Walker |
| 8,991,724 | B2 | 3/2015 | Sesser |
| 8,991,726 | B2 | 3/2015 | Kah, Jr. |
| 8,991,730 | B2 | 3/2015 | Kah, Jr. |
| 9,056,214 | B2 | 6/2015 | Barmoav |
| 9,079,202 | B2 | 7/2015 | Walker |
| 9,174,227 | B2 | 11/2015 | Robertson |
| 9,179,612 | B2 | 11/2015 | Nelson |
| 9,248,459 | B2 | 2/2016 | Kah, Jr. |
| 9,295,998 | B2 | 3/2016 | Shadbolt |
| 9,314,952 | B2 | 4/2016 | Walker |
| 9,327,297 | B2 | 5/2016 | Walker |
| 9,387,496 | B2 | 7/2016 | Kah, III |
| 9,427,751 | B2 | 8/2016 | Kim |
| 9,492,832 | B2 | 11/2016 | Kim |
| 9,504,209 | B2 | 11/2016 | Kim |
| 9,555,422 | B2 | 1/2017 | Zhao |
| 9,669,420 | B2 | 6/2017 | Heren |
| 9,757,743 | B2 | 9/2017 | Kah, Jr. |
| 9,776,195 | B2 | 10/2017 | Russell |
| 9,808,813 | B1 | 11/2017 | Porter |
| 9,937,513 | B2 | 4/2018 | Kah, III |
| 9,981,276 | B2 | 5/2018 | Kah, Jr. |
| 9,987,639 | B2 | 6/2018 | Russell |
| 10,092,913 | B2 | 10/2018 | Gopalan |
| 10,201,818 | B2 | 2/2019 | Duffin |
| 10,213,802 | B2 | 2/2019 | Kah, Jr. |
| 10,232,388 | B2 | 3/2019 | Glezerman |
| 10,232,389 | B1 | 3/2019 | Forrest |
| 10,239,067 | B2 | 3/2019 | Glezerman |
| 10,322,422 | B2 | 6/2019 | Simmons |
| 10,322,423 | B2 | 6/2019 | Walker |
| 2001/0023901 | A1 | 9/2001 | Haverstraw |
| 2002/0070289 | A1 | 6/2002 | Hsu |
| 2002/0130202 | A1 | 9/2002 | Kah |
| 2002/0139868 | A1 | 10/2002 | Sesser |
| 2002/0153434 | A1 | 10/2002 | Cordua |
| 2003/0006304 | A1 | 1/2003 | Cool |
| 2003/0015606 | A1 | 1/2003 | Cordua |
| 2003/0042327 | A1 | 3/2003 | Beutler |
| 2003/0071140 | A1 | 4/2003 | Roman |
| 2003/0075620 | A1 | 4/2003 | Kah |
| 2004/0108391 | A1 | 6/2004 | Onofrio |
| 2005/0006501 | A1 | 1/2005 | Englefield |
| 2005/0161534 | A1 | 7/2005 | Kah |
| 2005/0194464 | A1 | 9/2005 | Bruninga |
| 2005/0194479 | A1 | 9/2005 | Curtis |
| 2006/0038046 | A1 | 2/2006 | Curtis |
| 2006/0086832 | A1 | 4/2006 | Roberts |
| 2006/0086833 | A1 | 4/2006 | Roberts |
| 2006/0108445 | A1 | 5/2006 | Pinch |
| 2006/0144968 | A1 | 7/2006 | Lev |
| 2006/0150899 | A1 | 7/2006 | Han |
| 2006/0237198 | A1 | 10/2006 | Crampton |
| 2006/0273202 | A1 | 12/2006 | Su |
| 2006/0281375 | A1 | 12/2006 | Jordan |
| 2007/0012800 | A1 | 1/2007 | McAfee |
| 2007/0034711 | A1 | 2/2007 | Kah |
| 2007/0034712 | A1 | 2/2007 | Kah |
| 2007/0119975 | A1 | 5/2007 | Hunnicutt |
| 2007/0181711 | A1 | 8/2007 | Sesser |
| 2007/0210188 | A1 | 9/2007 | Schapper |
| 2007/0235565 | A1 | 10/2007 | Kah |
| 2007/0246567 | A1 | 10/2007 | Roberts |
| 2008/0087743 | A1 | 4/2008 | Govrin |
| 2008/0169363 | A1 | 7/2008 | Walker |
| 2008/0217427 | A1 | 9/2008 | Wang |
| 2008/0257982 | A1 | 10/2008 | Kah |
| 2008/0276391 | A1 | 11/2008 | Jung |
| 2008/0277499 | A1 | 11/2008 | McAfee |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah |
| 2009/0173904 | A1 | 7/2009 | Roberts |
| 2009/0188988 | A1 | 7/2009 | Walker |
| 2009/0224070 | A1 | 9/2009 | Clark |
| 2010/0078508 | A1 | 4/2010 | South |
| 2010/0090024 | A1 | 4/2010 | Hunnicutt |
| 2010/0108787 | A1 | 5/2010 | Walker |
| 2010/0176217 | A1 | 7/2010 | Richmond |
| 2010/0257670 | A1 | 10/2010 | Hodel |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2011/0024522 | A1 | 2/2011 | Anuskiewicz |
| 2011/0089250 | A1 | 4/2011 | Zhao |

(56) References Cited

U.S. PATENT DOCUMENTS

| | | | |
|---|---|---|---|
| 2011/0121097 | A1 | 5/2011 | Walker |
| 2011/0147484 | A1 | 6/2011 | Jahan |
| 2011/0248093 | A1 | 10/2011 | Kim |
| 2011/0248094 | A1 | 10/2011 | Robertson |
| 2011/0248097 | A1 | 10/2011 | Kim |
| 2011/0309161 | A1 | 12/2011 | Renquist |
| 2012/0012670 | A1 | 1/2012 | Kah |
| 2012/0061489 | A1 | 3/2012 | Hunnicutt |
| 2012/0153051 | A1 | 6/2012 | Kah |
| 2012/0273592 | A1 | 11/2012 | Zhang |
| 2012/0292403 | A1 | 11/2012 | Hunnicutt |
| 2013/0043050 | A1 | 2/2013 | Barmoav |
| 2013/0334332 | A1 | 12/2013 | Robertson |
| 2013/0334340 | A1 | 12/2013 | Walker |
| 2014/0027526 | A1 | 1/2014 | Shadbolt |
| 2014/0027527 | A1 | 1/2014 | Walker |
| 2014/0042251 | A1 | 2/2014 | Maksymec |
| 2014/0110501 | A1 | 4/2014 | Lawyer |
| 2014/0224900 | A1 | 8/2014 | Kim |
| 2014/0263735 | A1 | 9/2014 | Nations |
| 2014/0339334 | A1 | 11/2014 | Kah |
| 2015/0076253 | A1 | 3/2015 | Kah, Jr. |
| 2015/0083828 | A1 | 3/2015 | Maksymec |
| 2015/0144716 | A1 | 5/2015 | Barmoav |
| 2015/0158036 | A1 | 6/2015 | Kah, Jr. |
| 2015/0165455 | A1 | 6/2015 | Kah |
| 2015/0273492 | A1 | 10/2015 | Barmoav |
| 2015/0321207 | A1 | 11/2015 | Kah |
| 2017/0056899 | A1 | 3/2017 | Kim |
| 2017/0128963 | A1 | 5/2017 | Liln |
| 2017/0203311 | A1 | 7/2017 | Kim |
| 2017/0348709 | A1 | 12/2017 | Kah, Jr. |
| 2018/0015487 | A1 | 1/2018 | Russell |
| 2018/0058684 | A1 | 3/2018 | Qiu |
| 2018/0141060 | A1 | 5/2018 | Walker |
| 2018/0221895 | A1 | 8/2018 | McCarty |
| 2018/0250692 | A1 | 9/2018 | Kah, Jr. |
| 2018/0257093 | A1 | 9/2018 | Glezerman |
| 2018/0280994 | A1 | 10/2018 | Walker |
| 2018/0311684 | A1 | 11/2018 | Lawyer |
| 2019/0015849 | A1 | 1/2019 | Geerligs |
| 2019/0022442 | A1 | 1/2019 | Jimenez |
| 2019/0054480 | A1 | 2/2019 | Sesser |
| 2019/0054481 | A1 | 2/2019 | Sesser |
| 2019/0118195 | A1 | 4/2019 | Geerligs |
| 2019/0133059 | A1 | 5/2019 | DeWitt |
| 2019/0143361 | A1 | 5/2019 | Kah, Jr. |
| 2019/0193095 | A1 | 6/2019 | Sesser |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| DE | 19925279 | | 12/1999 |
| EP | 463742 | | 1/1992 |
| EP | 489679 | | 6/1992 |
| EP | 518579 | | 12/1992 |
| EP | 572747 | | 12/1993 |
| EP | 646417 | | 4/1995 |
| EP | 0724913 | A2 | 8/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| FR | 2730901 | | 9/1997 |
| GB | 908314 | | 10/1962 |
| IL | 35182 | | 4/1973 |
| WO | 1234723 | | 6/1971 |
| WO | 1995020988 | | 8/1995 |
| WO | 1997027951 | | 8/1997 |
| WO | 9735668 | | 10/1997 |
| WO | 2330783 | | 5/1999 |
| WO | 2000007428 | | 12/2000 |
| WO | 200131996 | | 5/2001 |
| WO | 2001031996 | | 5/2001 |
| WO | 200162395 | | 8/2001 |
| WO | 2001062395 | | 8/2001 |
| WO | 2002078857 | | 10/2002 |
| WO | 2002098570 | | 12/2002 |
| WO | 2003086643 | | 10/2003 |
| WO | 2004052721 | | 6/2004 |
| WO | 2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |
| WO | 2011075690 | | 6/2011 |
| WO | 2014018892 | | 1/2014 |

OTHER PUBLICATIONS

Advisory Action dated Jul. 14, 2011 for U.S. Appl. No. 11/947,571 (3 pgs.).

Applicant-Initiated Interview Summary and Final Office Action dated Mar. 5, 2014 for U.S. Appl. No. 12/972,271 (12 pgs.).

EPO Search Report and Opinion, dated Aug. 5, 2010 for EPO Application No. 10164085.2 (5 pgs.).

Final Office Action dated Apr. 5, 2011 for U.S. Appl. No. 11/947,571 (11 pgs.).

Final Office Action dated Dec. 5, 2013 for U.S. Appl. No. 12/972,271 (9 pgs.).

Interview Summary dated Sep. 26, 2011 for U.S. Appl. No. 12/475,242 (3 pgs.).

Non-Final Office Action dated Dec. 16, 2014 for U.S. Appl. No. 13/560,423 (18 pgs.).

Non-Final Office Action dated Jan. 10, 2014 for U.S. Appl. No. 13/069,334 (6 pgs.).

Non-Final Office Action dated Jan. 22, 2015 for U.S. Appl. No. 13/828,582 (21 pgs.).

Non-Final Office Action dated Nov. 5, 2014 for U.S. Appl. No. 13/495,402.

Non-Final Office Action dated Apr. 10, 2013 for U.S. Appl. No. 13/562,825 (22 pgs.).

Non-Final Office Action dated Aug. 24, 2010 for U.S. Appl. No. 11/947,571 (11 pgs.).

Non-Final Office Action dated Dec. 16, 2014 for U.S. Appl. No. 13/560,423.

Non-Final Office Action dated Dec. 4, 2012 for U.S. Appl. No. 12/686,895 (29 pgs.).

Non-Final Office Action dated Jan. 5, 2011 for U.S. Appl. No. 12/248,644 (20 pgs.).

Non-Final Office Action dated Jul. 20, 2011 for U.S. Appl. No. 12/475,242 (17 pgs.).

Non-Final Office Action dated Jun. 5, 2013 for U.S. Appl. No. 12/972,271 (8 pgs.).

Non-Final Office Action dated Jun. 7, 2012 for U.S. Appl. No. 13/300,946 (9 pgs.).

Non-Final Office Action dated Mar. 29, 2011 for U.S. Appl. No. 12/475,242 (7 pgs.).

Non-Final Office Action dated May 24, 2013 U.S. Appl. No. 12/720,261 (67 pgs.).

(56) References Cited

OTHER PUBLICATIONS

Non-Final Office Action dated Oct. 12, 2012 for U.S. Appl. No. 13/300,946 (7 pgs.).
Non-Final Office Action dated Oct. 15, 2012 for U.S. Appl. No. 13/562,825 (10 pgs.).
Non-Final Office Action dated Oct. 15, 2012 for U.S. Appl. No. 13/562,825 (20 pgs.).
Non-Final Office Action dated Sep. 3, 2013 for U.S. Appl. No. 13/300,946. (5 pgs.).
Non-Final Office Action dated Sep. 30, 2010 for U.S. Appl. No. 12/248,644 (7 pgs.).
Response dated Apr. 10, 2015 to Office Action dated Dec. 16, 2014 for U.S. Appl. No. 13/560,423 (21 pgs).
Response dated Apr. 22, 2015 to Non-Final Office Action dated Jan. 22, 2015 for U.S. Appl. No. 13/828,582 (19 pgs).
Response dated Apr. 29, 2011 to Office Action dated Mar. 29, 2011 for U.S. Appl. No. 12/475,242 (13 pgs.).
Response dated Feb. 10, 2014 to Office Action dated Jan. 10, 2014 for U.S. Appl. No. 13/069,334 (3 pgs.).
Response dated Feb. 4, 2015 to Office Action dated Nov. 5, 2014 for U.S. Appl. No. 13/495,402 (16 pgs.).
Response dated Jul. 25, 2012 to Non-Final Office Action dated Apr. 25, 2012 for U.S. Appl. No. 12/757,912 (27 pgs.).
Response dated Jun. 25, 2012 to Office Action dated Jun. 7, 2012 for U.S. Appl. No. 13/300,946 (12 pgs.).
Response dated Mar. 25, 2013 to Final Rejection dated Oct. 23, 2012 for U.S. Appl. No. 12/757,912 (20 pgs.).
Response dated Nov. 24, 2010 to Office Action dated Aug. 24, 2010 for U.S. Appl. No. 11/947,571 (19 pgs.).
Response dated Oct. 18, 2011 to Office Action dated Jul. 20, 2011 for U.S. Appl. No. 11/947,571 (11 pgs.).
Response dated Oct. 18, 2011 to Office Action dated Jul. 20, 2011 for U.S. Appl. No. 12/475,242 (17 pgs.).
Response dated Sep. 16, 2013 to Office Action dated Jun. 5, 2013 for U.S. Appl. No. 12/972,271 (15 pgs.).
USPTO Applicant-Initiated Interview Summary dated Apr. 23, 2013 for U.S. Appl. No. 12/757,912 (3 pgs.).
USPTO Final Rejection dated Oct. 23, 2012 for U.S. Appl. No. 12/757,912 (19 pgs.).
USPTO Non-Final Office Action dated Apr. 25, 2012 for U.S. Appl. No. 12/757,912 (17 pgs.).
USPTO; U.S. Appl. No. 13/560,423; Notice of Allowance dated Nov. 12, 2015.
USPTO; U.S. Appl. No. 13/560,423; Office Action dated Jun. 10, 2015.
USPTO; U.S. Appl. No. 13/828,582; Non-Final Office Action dated Jan. 22, 2015.
USPTO; U.S. Appl. No. 13/828,582; Notice of Allowance dated Jan. 7, 2016.
USPTO; U.S. Appl. No. 13/828,582; Office Action dated Jul. 6, 2015.
USPTO; U.S. Appl. No. 13/495,402; Notice of Allowance dated Mar. 6, 2015.
Written Opinion of the International Searching Authority and International Search Report dated Apr. 19, 2011 for Application No. PCT/US10/61132 (12 pgs.).
USPTO; U.S. Appl. No. 16/289,252; Office Action dated Jan. 15, 2021; (pp. 1-8).

* cited by examiner

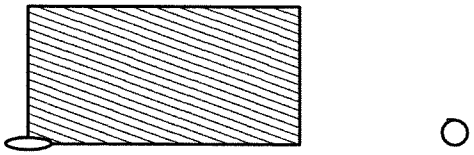
FIG. 9D
FIG. 9C
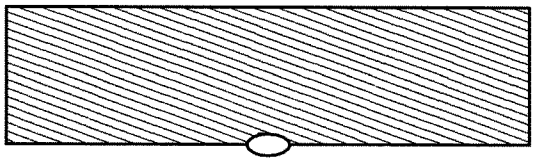
FIG. 9B
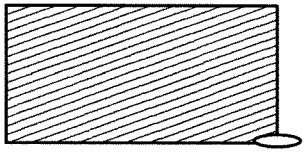
FIG. 9A
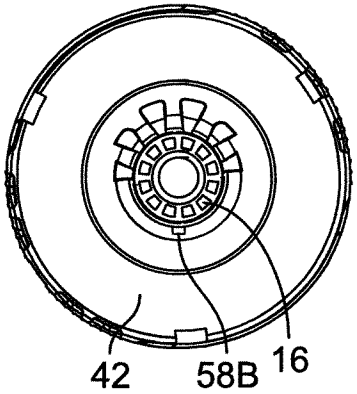
FIG. 8D
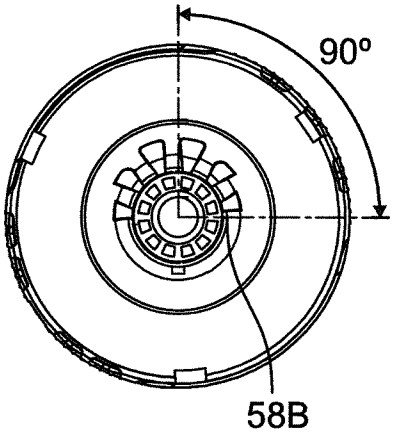
FIG. 8C
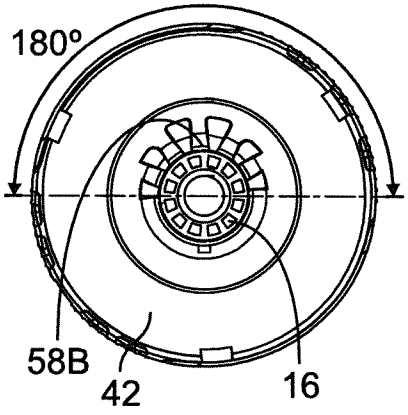
FIG. 8B
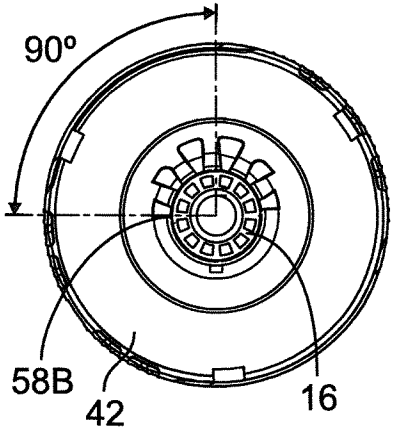
FIG. 8A

ROTARY STRIP NOZZLES

FIELD

The invention relates to irrigation nozzles and, more particularly, to a rotary nozzle for distribution of water in a strip irrigation pattern.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotating deflector or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, water is directed upwardly against a rotatable deflector having a vaned lower surface defining an array of relatively small flow channels extending upwardly and turning radially outwardly with a spiral component of direction. The water impinges upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the amount of water through the nozzle, among other things.

In some applications, it is desirable to be able to set either a rotating stream or a fixed spray nozzle for irrigating a rectangular area of the terrain. Specialty nozzles have been developed for irrigating terrain having specific geometries, such as rectangular strips, and these specialty nozzles include left strip, right strip, and side strip nozzles. Some of these specialty nozzles, however, do not cover the desired strip pattern accurately. They may not cover the entire desired pattern or may also irrigate additional terrain surrounding the desired strip pattern. In addition, in some circumstances, it may be desirable to have one nozzle that can be adjusted to accommodate different strip geometries, such as side strip, left strip, or right strip orientations.

It is also desirable to control or regulate the throw radius of the water distributed to the surrounding terrain. In this regard, in the absence of a radius adjustment device, the irrigation nozzle will have limited variability in the throw radius of water distributed from the nozzle. The inability to adjust the throw radius results both in the wasteful and insufficient watering of terrain. A radius adjustment device is desired to provide flexibility in water distribution through varying radius pattern, and without varying the water pressure from the source. Some designs provide only limited adjustability and, therefore, allow only a limited range over which water may be distributed by the nozzle.

Accordingly, a need exists for a nozzle that can accurately irrigate a desired strip pattern. Further, in some circumstances, there is a need for a specialty nozzle that provides strip irrigation of different geometries and eliminates the need for multiple models. In addition, a need exists to increase the adjustability of the throw radius of an irrigation nozzle without varying the water pressure.

BRIEF DESCRIPTION OF THE DRAWINGS

FIGS. 8A-D are top plan views of the assembled valve sleeve and nozzle housing of the nozzle of FIG. 1 in a left strip (90 degree), side strip (180 degree), right strip (90 degree), and shut-off configuration, respectively;

FIGS. 9A-D are representational views of the irrigation patterns and coverage areas of the left strip (90 degree), side strip (180 degree), right strip (90 degree), and shut-off configuration, respectively;

DESCRIPTION OF THE PREFERRED EMBODIMENTS

Figure 1:
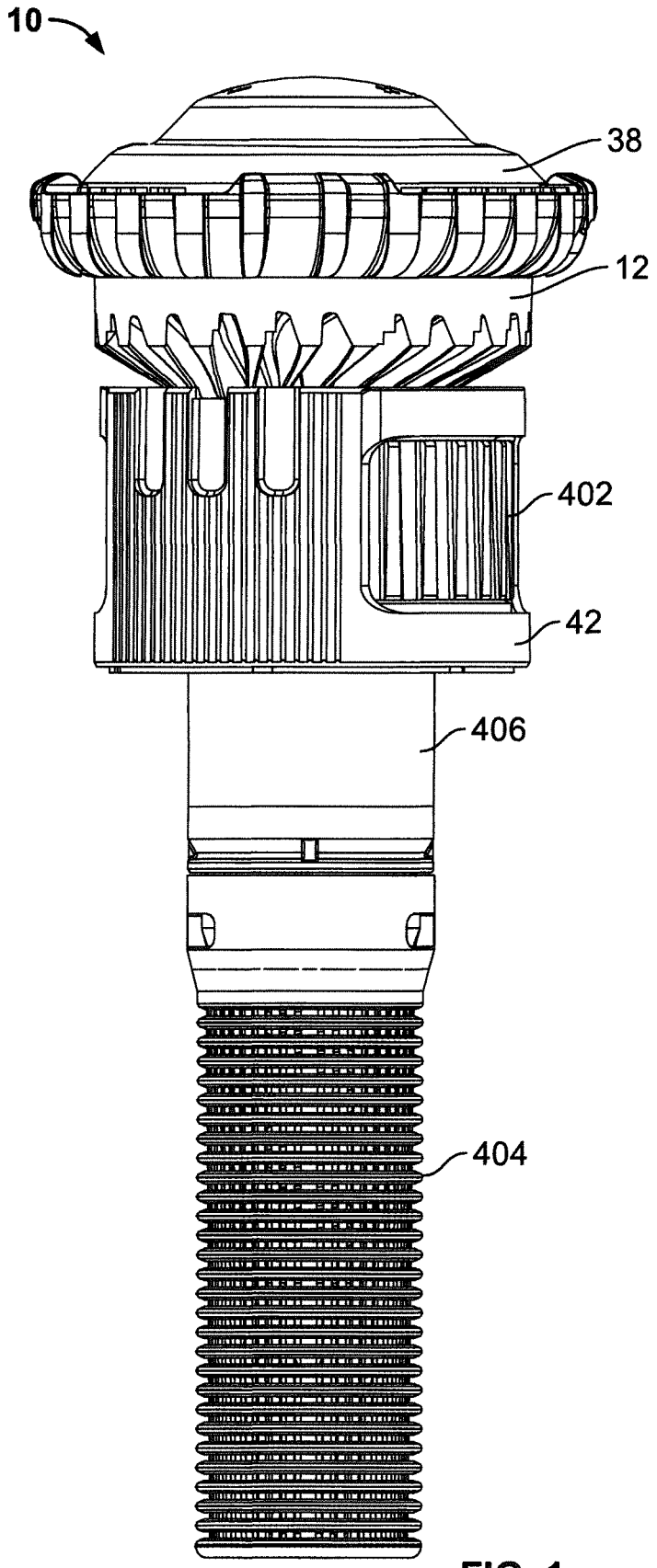
FIG. 1 is a perspective view of a first embodiment of a nozzle embodying features of the present invention.

FIGS. 1-4B show a first embodiment of a sprinkler head or nozzle 10 that allows a user to adjust the nozzle 10 to four different strip irrigation settings. The pattern adjustment feature does not require a hand tool to access a slot at the top of the nozzle 10 to rotate a shaft. Instead, the user may depress part or all of the deflector 12 and rotate the deflector 12 to directly set a pattern adjustment valve 14. The nozzle 10 also preferably includes a radius adjustment feature, which is shown in FIGS. 1-4B, to change the throw radius. The radius adjustment feature is accessible by rotating an outer wall portion of the nozzle 10, as described further below.

Some of the structural components of the nozzle 10 are similar to those described in U.S. Pat. Nos. 9,295,998 and 9,327,297, which are assigned to the assignee of the present application and which patents are incorporated herein by reference in their entirety. Also, some of the user operation for pattern and radius adjustment is similar to that described in these two applications. Differences are addressed below and can be seen with reference to the figures.

As described in more detail below, the nozzle 10 allows a user to depress and rotate the deflector 12 to directly actuate the pattern adjustment valve 14, i.e., to adjust the setting of the valve 14 to the desired strip irrigation pattern. The deflector 12 directly engages and rotates one of the two nozzle body portions that form the valve 14 (valve sleeve 16). The valve 14 preferably operates through the use of two valve bodies to define a valve opening. Although the nozzle 10 preferably includes a shaft 20, the user preferably does not need to use a hand tool to effect rotation of the shaft 20 to adjust the pattern adjustment valve 14. The shaft 20 is preferably not rotated to adjust the valve 14. Indeed, in certain forms, the shaft 20 may be fixed against rotation, such as through use of splined engagement surfaces.

As can be seen in FIGS. 1-4B, the nozzle 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 17. The water preferably passes through an inlet 412 controlled by a radius adjustment feature that regulates the amount of fluid flow through the nozzle body 17. Water is then directed generally upwardly through the pattern adjustment valve 14 to produce upwardly directed water jets that impinge the underside surface of a deflector 12 for rotatably driving the deflector 12.

Figure 4A:
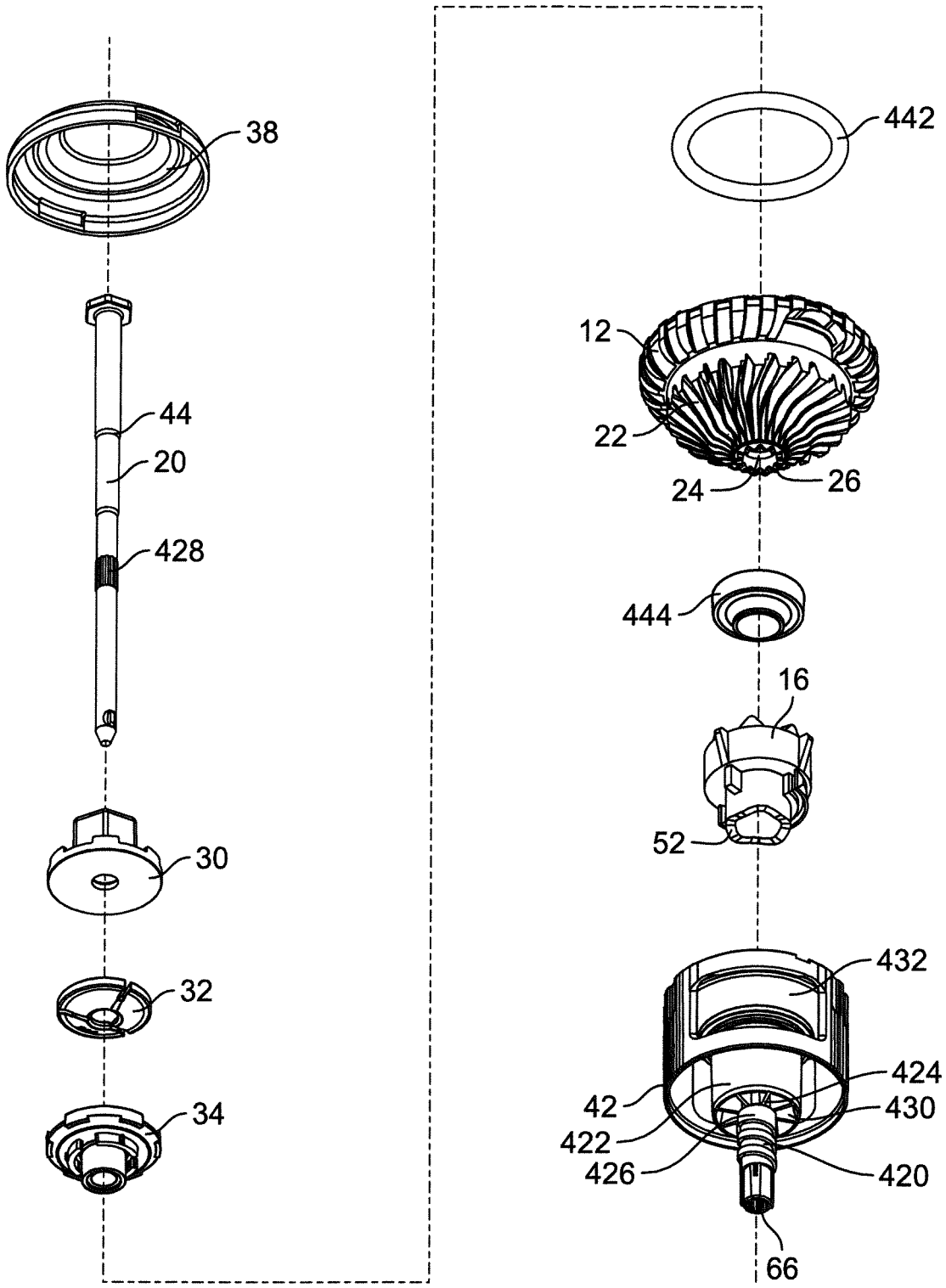
FIGS. 4A and 4B are bottom exploded perspective views of the nozzle of FIG. 1.

The rotatable deflector 12 has an underside surface that is preferably contoured to deliver a plurality of fluid streams generally radially outwardly. As shown in FIG. 4A, the underside surface of the deflector 12 preferably includes an array of spiral vanes 22. The spiral vanes 22 subdivide the water into the plurality of relatively small water streams which are distributed radially outwardly to surrounding terrain as the deflector 12 rotates. The vanes 22 define a plurality of intervening flow channels extending upwardly and spiraling along the underside surface to extend generally radially outwardly with selected inclination angles. During operation of the nozzle 10, the upwardly directed water impinges upon the lower or upstream segments of these vanes 22, which subdivide the water flow into the plurality of relatively small flow streams for passage through the flow channels and radially outward projection from the nozzle 10. Any deflector suitable for distributing fluid radially outward from the nozzle 10 may be used.

The deflector 12 has a bore 24 for insertion of a shaft 20 therethrough. As can be seen in FIG. 4A, the bore 24 is defined at its lower end by circumferentially-arranged, downwardly-protruding teeth 26. As described further below, these teeth 26 are sized to engage corresponding teeth 28 on the valve sleeve 16. This engagement allows a user to depress the deflector 12 and thereby directly engage and drive the valve sleeve 16 for adjusting the valve 14. Also, the deflector 12 may optionally include a screwdriver slot and/or a coin slot in its top surface (not shown) to allow other methods for adjusting the valve 14. Optionally, the deflector 12 may also include a knurled external surface about its perimeter to provide for better gripping by a user making a strip pattern adjustment.

The deflector 12 also preferably includes a speed control brake to control the rotational speed of the deflector 12. In one preferred form shown in FIGS. 2, 3A, and 4A, the speed control brake includes a friction disk 30, a brake pad 32, and a seal retainer 34. The friction disk 30 preferably has an internal surface for engagement with a top surface on the shaft 20 so as to fix the friction disk 30 against rotation. The seal retainer 34 is preferably welded to, and rotatable with, the deflector 12 and, during operation of the nozzle 10, is urged against the brake pad 32, which, in turn, is retained against the friction disk 30. Water is directed upwardly and strikes the deflector 12, pushing the deflector 12 and seal retainer 34 upwards and causing rotation. In turn, the rotating seal retainer 34 engages the brake pad 32, resulting in frictional resistance that serves to reduce, or brake, the rotational speed of the deflector 12. Speed brakes like the type shown in U.S. Pat. No. 9,079,202 and U.S. patent application Ser. No. 15/359,286, which are assigned to the assignee of the present application and are incorporated herein by reference in their entirety, are preferably used. Although the speed control brake is shown and preferably used in connection with nozzle 10 described and claimed herein, other brakes or speed reducing mechanisms are available and may be used to control the rotational speed of the deflector 12.

The deflector 12 is supported for rotation by shaft 20. Shaft 20 extends along a central axis of the nozzle 10, and the deflector 12 is rotatably mounted on an upper end of the shaft 20. As can be seen from FIG. 2, the shaft 20 extends through the bore 24 in the deflector 12 and through aligned bores in the friction disk 30, brake pad 32, and seal retainer 34, respectively. A cap 38 is mounted to the top of the deflector 12. The cap 38 prevents grit and other debris from coming into contact with the components in the interior of the deflector 12, such as the speed control brake components, and thereby hindering the operation of the nozzle 10.

Figure 2:
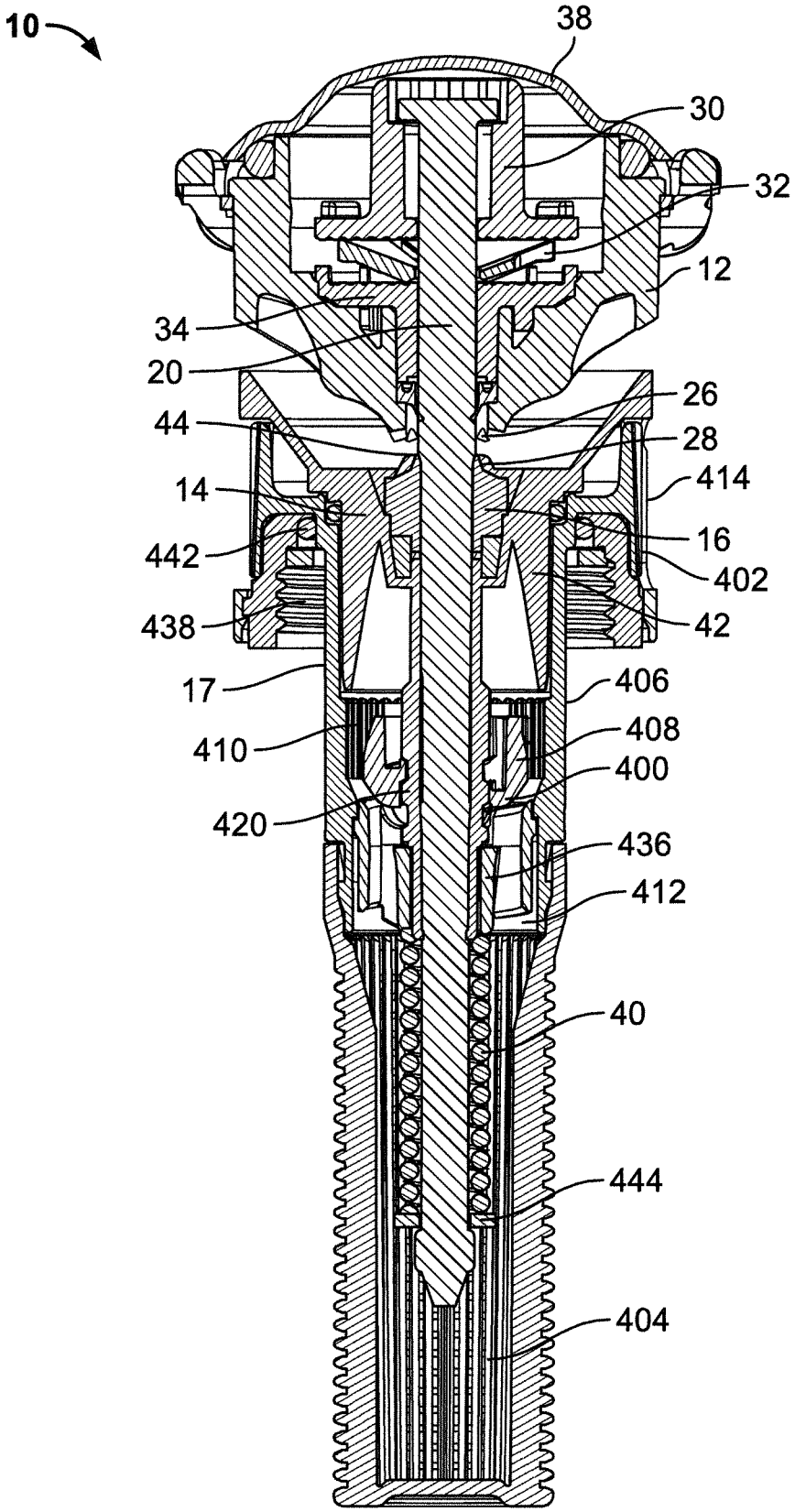
FIG. 2 is a cross-sectional view of the nozzle of FIG. 1.

A spring 40 mounted to the shaft 20 energizes and tightens the seal and engagement of the pattern adjustment valve 14. More specifically, the spring 40 operates on the shaft 20 to bias the first of the two nozzle body portions that forms the valve 14 (valve sleeve 16) downwardly against the second portion (nozzle housing 42). By using a spring 40 to maintain a forced engagement between valve sleeve 16 and nozzle housing 42, the nozzle 10 provides a tight seal of the pattern adjustment valve 14, concentricity of the valve 14, and a uniform jet of water directed through the valve 14. In addition, mounting the spring 40 at one end of the shaft 20 results in a lower cost of assembly. As can be seen in FIG. 2, the spring 40 is mounted near the lower end of the shaft 20 and downwardly biases the shaft 20. In turn, the shaft shoulder 44 exerts a downward force on the washer/retaining ring 444 and valve sleeve 16 for pressed fit engagement with the nozzle housing 42.

The pattern adjustment valve 14 allows the nozzle 10 to function as a left strip nozzle, a right strip nozzle, a side strip nozzle, and a shut-off nozzle. As used herein, a left strip refers to a rectangular area to the left of the nozzle, and conversely, a right strip refers to a rectangular area to the right of the nozzle. The orientations of "left strip" and "right strip" depend on the viewpoint of the user (such as from behind the nozzle or in front of the nozzle). For purposes of this application, "left strip" and "right strip" have been selected as being to the left and right of a nozzle from the viewpoint of a user positioned behind the nozzle. (See FIGS. 8A-D and 9A-D.) Further, as used herein, a side strip refers to a rectangular irrigation area in which the nozzle is positioned at the midpoint of one of the longer legs of the larger rectangle. In one preferred form, as can be seen in FIGS. 9A-9C, the side strip irrigation pattern defines a larger rectangle (FIG. 9B), while the left and right strip irrigation patterns define smaller rectangles (FIGS. 9A and 9C) that, when combined, form the larger rectangle.

As described further below, the pattern adjustment valve 14 may be adjusted by a user to transform the nozzle 10 into a left strip nozzle, a right strip nozzle, a side strip nozzle, or a shut-off nozzle, at the user's discretion. The user adjusts the valve 14 by depressing the deflector 12 to engage the first valve body (valve sleeve 16) and then rotating the first valve body between the four different positions relative to the second valve body (nozzle housing 42). The first position allows the nozzle 10 to function as a left strip nozzle, the second position allows it to function as a right strip nozzle, the third position allows it to function as a side strip nozzle, and the fourth position allows it be shut-off (no irrigation). The shut-off option might be desirable, for example, where multiple nozzles are arranged on terrain and a main valve controls fluid flow to all of them.

Figure 3A:
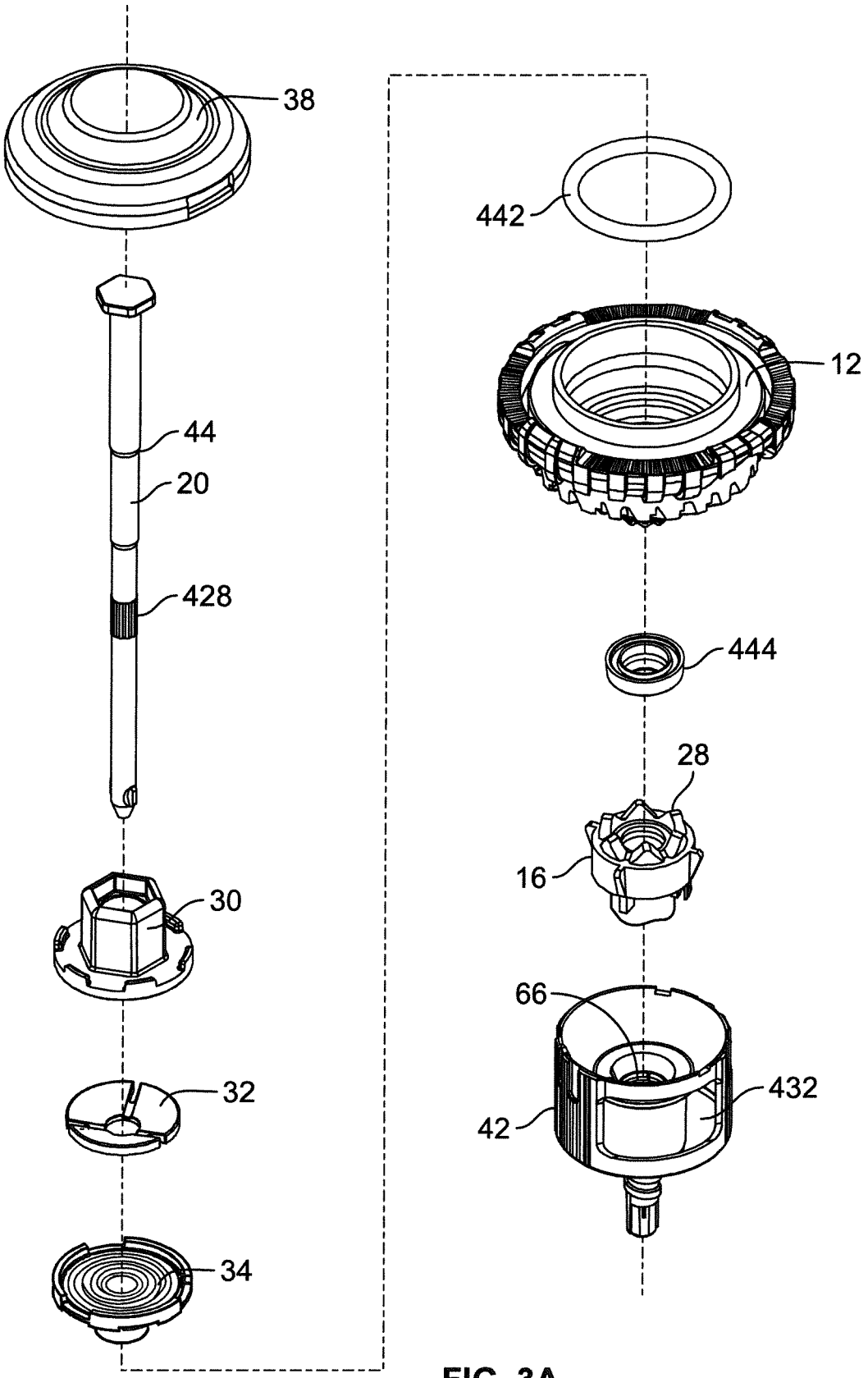
FIGS. 3A and 3B are top exploded perspective views of the nozzle of FIG. 1.

The valve 14 preferably includes two valve bodies that interact with one another to adjust the strip setting: the rotating valve sleeve 16 and the non-rotating nozzle housing 42. As shown in FIGS. 2, 3A, and 4A, the valve sleeve 16 is generally cylindrical in shape and, as described above, includes a top surface with teeth 28 for engagement with corresponding teeth 26 of the deflector 12. When the user depresses the deflector 12, the two sets of teeth engage, and the user may then rotate the deflector 12 to effect rotation of the valve sleeve 16 to set the desired strip of irrigation. The valve sleeve 16 also includes a central bore 46 for insertion of the shaft 20 therethrough.

Figure 5:
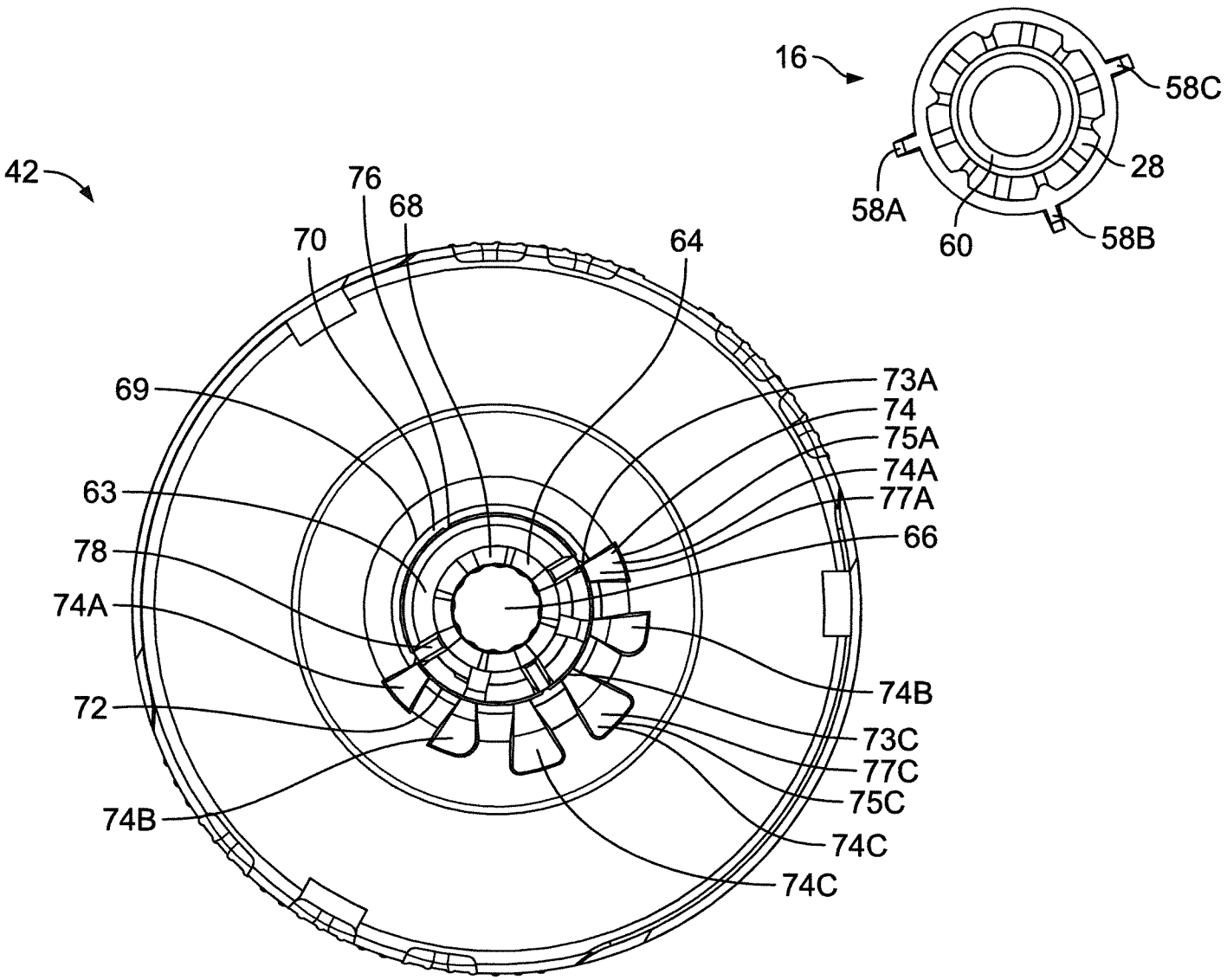
FIG. 5 is a top plan view of the unassembled valve sleeve and nozzle housing of the nozzle of FIG. 1.
Figure 6:
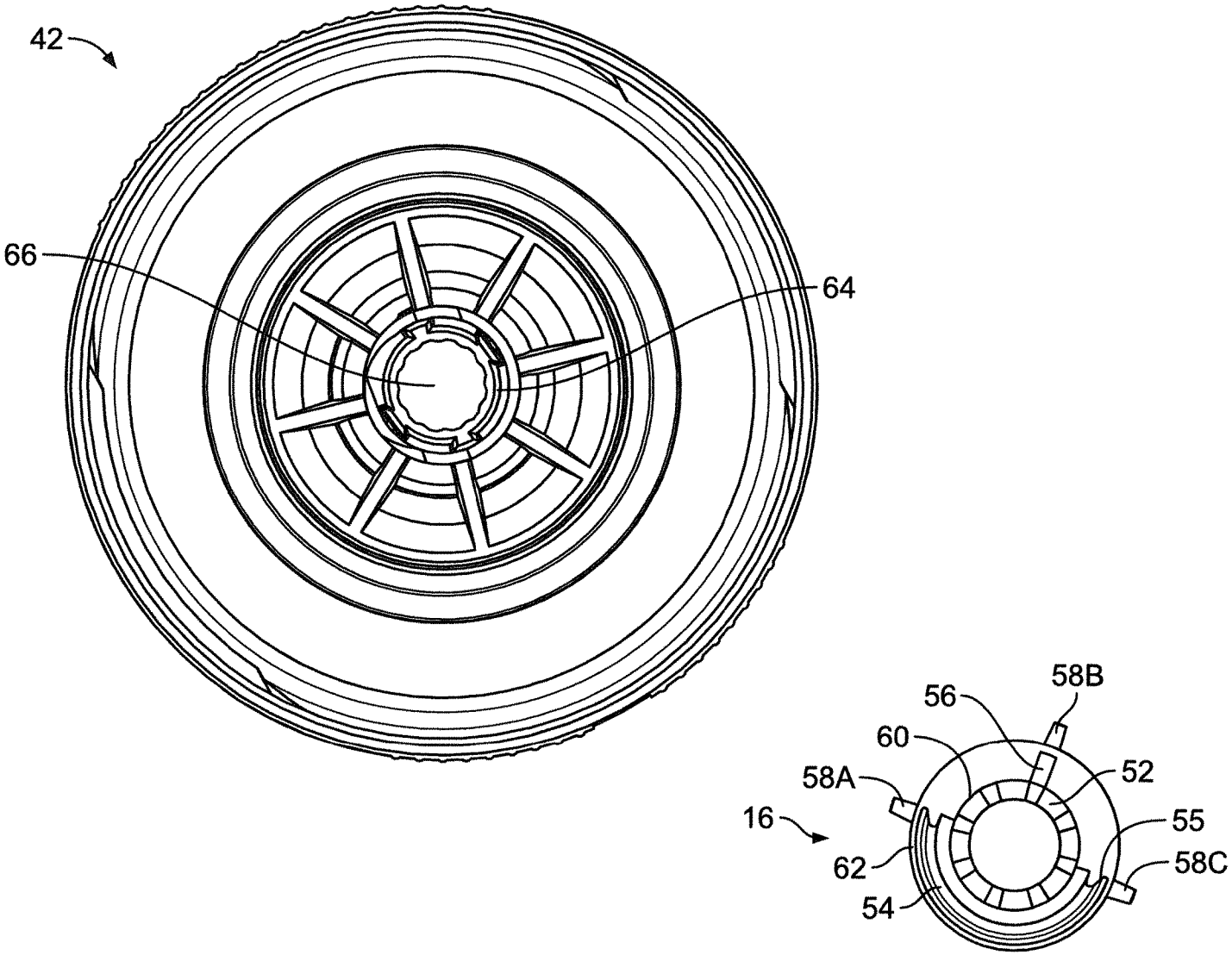
FIG. 6 is a bottom plan view of the unassembled valve sleeve and nozzle housing of the nozzle of FIG. 1.
Figure 7A:
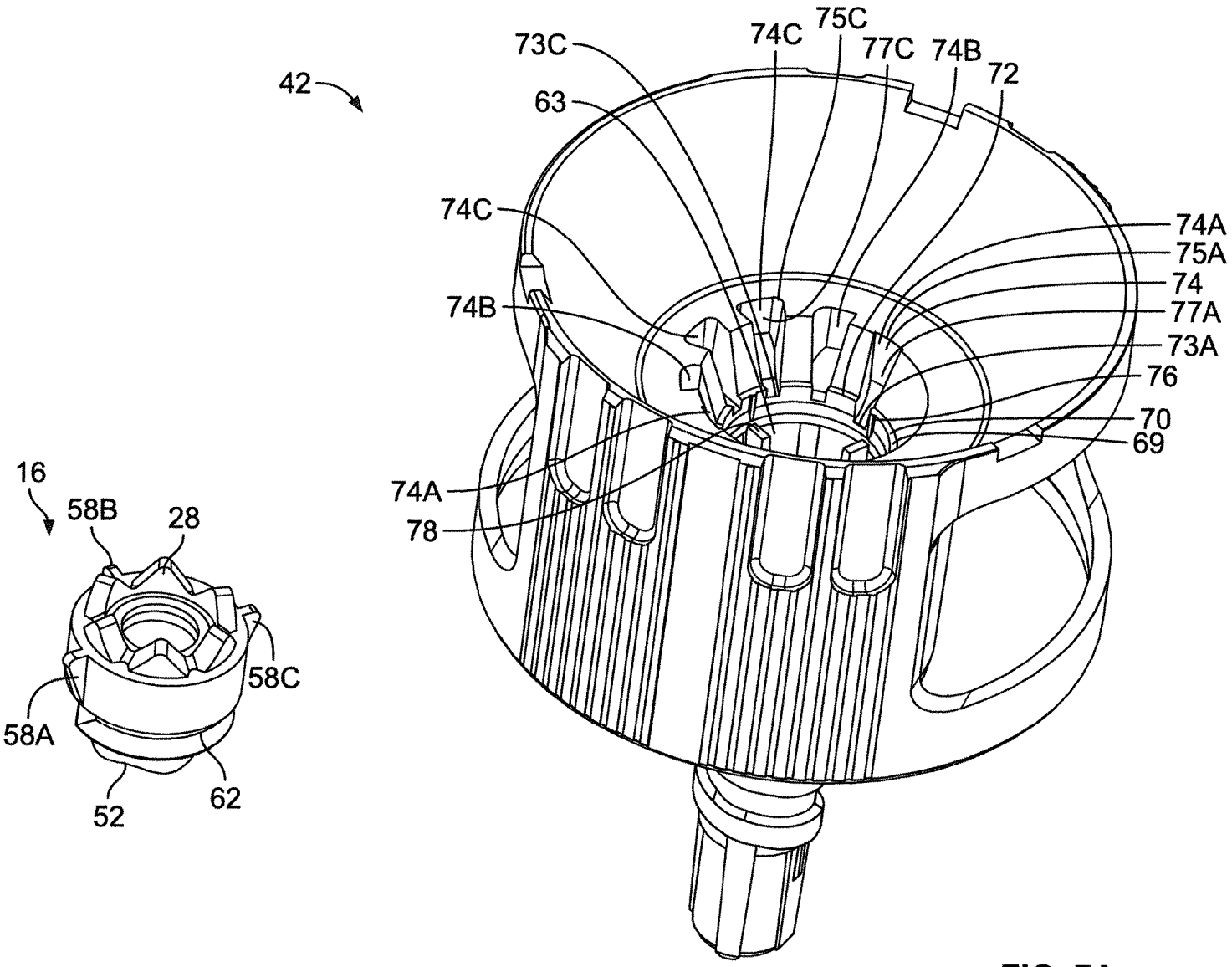
FIGS. 7A and 7B are perspective views of the unassembled valve sleeve and nozzle housing of the nozzle of FIG. 1.
Figure 7B:
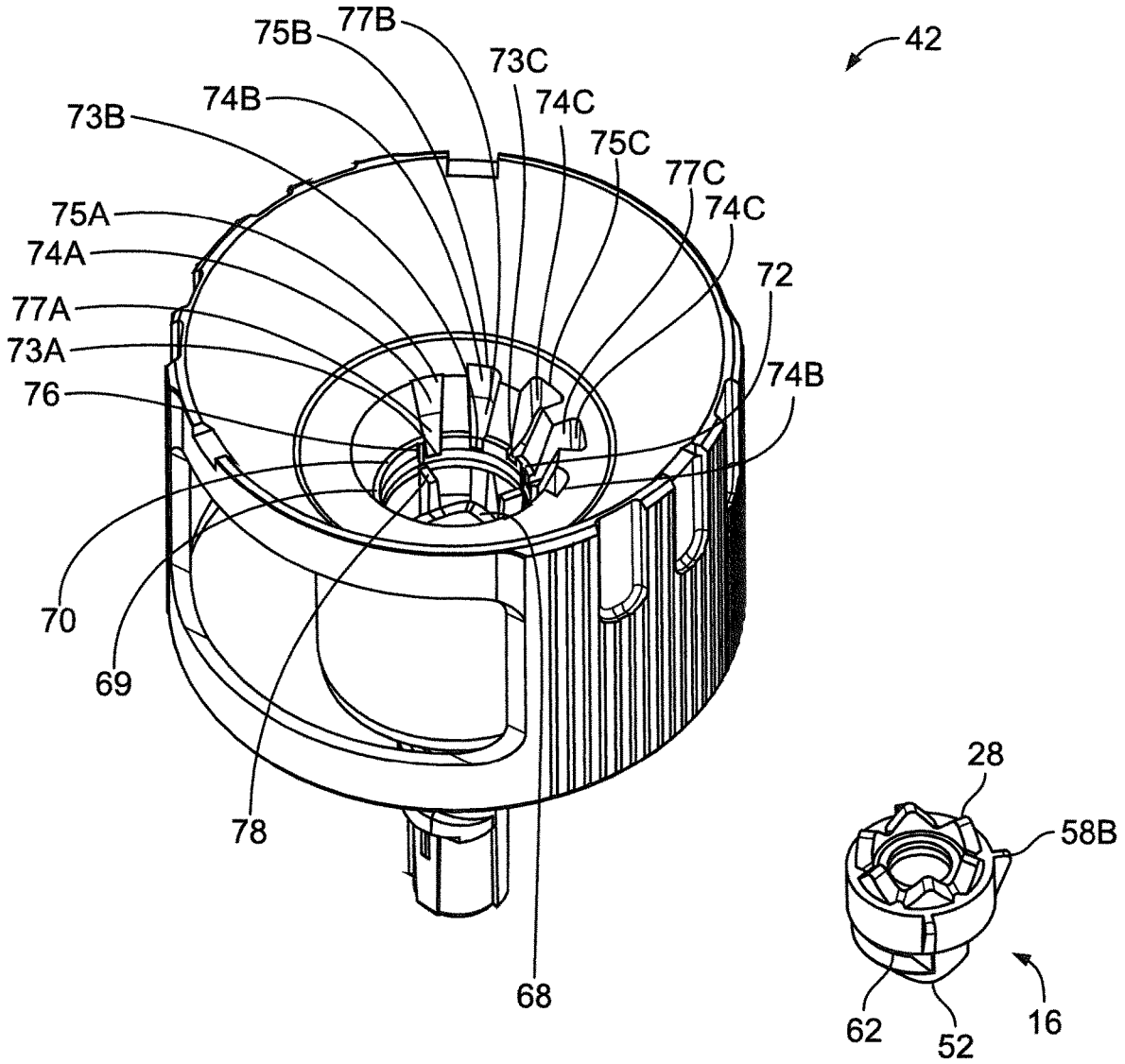
Figure 7C:
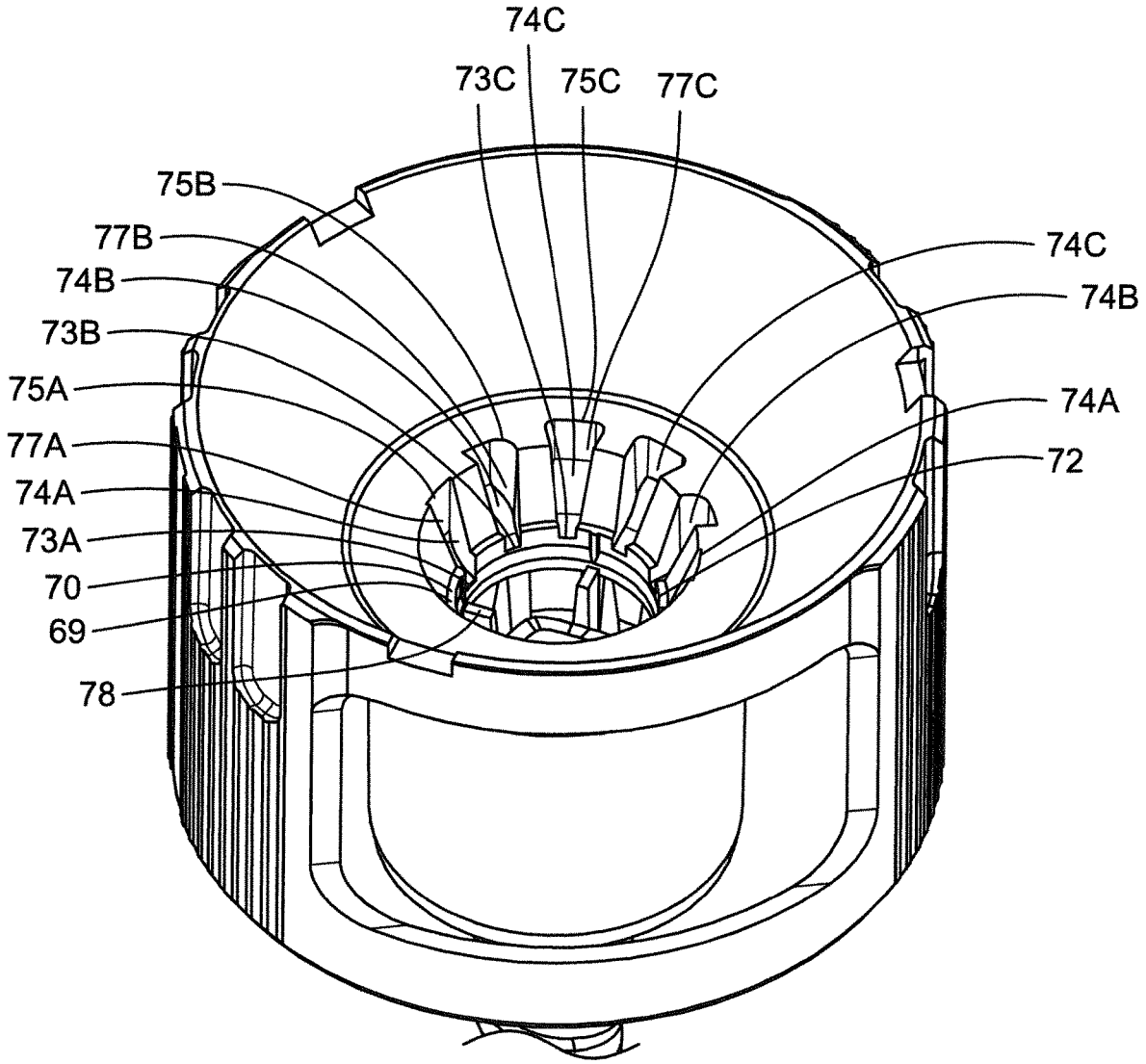
FIG. 7C is a perspective view of a portion of the nozzle housing of the nozzle of FIG. 1.

The valve sleeve 16 and nozzle housing 42 are shown in FIGS. 5-7 and are described further below. The valve sleeve 16 includes a bottom surface 52 that allows rotation of the valve sleeve to four distinct settings. More specifically, the bottom surface 52 is in the form of an undulating surface with four sets of alternating elevated and depressed portions. This bottom surface 52 is arranged so that it engages a complementary top undulating surface 68 of the nozzle housing 42. In this manner, as explained further below, a user may rotate the valve sleeve 16 between four distinct settings where the complementary surfaces of the valve sleeve 16 and nozzle housing 42 fully engage one another.

The valve sleeve 16 also includes a shutter 54, a divider wall 56, and edge fins 58. More specifically, the shutter 54 extends about 180 degrees around a central hub 60 of the valve sleeve 16 and is generally intended to block fluid flow up from the nozzle housing 42 in certain orientations. The valve sleeve 16 also includes an outer arcuate lip 62 for alignment and engagement with a corresponding guide feature of the nozzle housing 42, as addressed further below. The divider wall 56 is disposed on the central hub 60 and is preferably spaced equidistantly about 90 degrees from each end 55 of the shutter 54. The edge fins 58 (preferably three edge fins 58A, 58B, 58C) are disposed on the central hub 60, and the edge fins 58 and divider wall 56 are intended to define edges of fluid flowing past the valve sleeve 16. As can be seen, one of the edge fins 58 (middle edge fin 58B) is preferably aligned with the divider wall 56, and the two other edge fins 58A and 58C preferably are aligned with the ends 55 of the shutter 54.

As shown in FIGS. 5 and 7A-7C, the nozzle housing 42 includes a cylindrical recess 63 that receives and supports the valve sleeve 16 therein. The nozzle housing 42 has a central hub 64 that defines a central bore 66 that receives the shaft 20, which further supports the valve sleeve 16. The central hub 64 includes the undulating support surface 68 (described above) that includes four sets of alternating elevated and depressed portions that complement corresponding portions on the bottom surface 52 of the valve sleeve 16. As addressed above, this support surface 68, in combination with the bottom surface 52 of the valves sleeve 16, defines four settings of the strip nozzle 10. In other words, it serves as a detent mechanism on the central hub 64 to allow discrete indexing of the valve sleeve 16 to four different positions.

The nozzle housing 42 has a circumferential ledge 70 to allow the outer arcuate lip 62 of the valve sleeve 16 to ride therealong and seal. The ledge 70 engages and provides additional support to the valve sleeve 16. The ledge 70 does not extend along the entire circumference but extends approximately 180 degrees about the circumference. When the user rotates the valve sleeve 16, the outer arcuate lip 62 travels along and is guided by the ledge 70. The nozzle housing 42 also includes interrupted step portions 72 that are generally co-planar with the ledge 70 and extend along the roughly 180 degrees opposite the ledge 70. These step portions 72 also support the valve sleeve 16 as it is seated in one of the four different settings. The co-planar ledge 70 and step portions 72 collectively define a sealing surface 69 to allow rotation of the valve sleeve 16 while limiting upward flow of fluid other than through flow channels 74.

The nozzle housing 42 also includes six flow channels 74 that fill in various parts of the strip irrigation pattern. These six flow channels 74 can be divided into two sets of three flow channels 74A, 74B, and 74C that are essentially mirror images of one another with each set filling in half of the large rectangular irrigation pattern (when in the side strip setting). The three flow channels 74A, 74B, and 74C of each set are preferably staggered so that their upstream inlets are at different heights, their downstream exits are at different radial positions, and their contours are different to reduce the energy and velocity of fluid flowing through the channels 74A, 74B, and 74C in a different manner. Further, in this preferred form, the three flow channels 74A, 74B, and 74C are staggered in terms of inlet size with flow channel 74A having the largest inlet and flow channel 74C having the smallest inlet. More specifically, the two outermost flow channels 74A have the lowest and largest inlet 73A (extending furthest upstream), the closest radial downstream exit 75A, and a contour 77A to reduce fluid energy and velocity the least. In contrast, the two innermost flow channels 74C have the highest and smallest inlet 73C (extending the shortest distance upstream), the most distant radial downstream exit 75C, and a contour 77C to reduce fluid energy and velocity the most. The intermediate flow channels 74B have intermediate characteristics. In this manner, the outermost flow channels 74A fill the most distant parts of the strip irrigation pattern, the intermediate flow channels 74B fill intermediate parts, and the innermost flow channels 74C fill the closest parts. As addressed, the three flow channels 74A, 74B, and 74C are staggered in terms of inlet size, but, in other forms, it is contemplated that this may be accomplished without staggering the inlet height. It should be understood that the structure and positions of the upstream inlets, downstream exits, and/or contours of the flow channels 74 may be fine-tuned, as appropriate, to create different types of nozzles 10 with varying flow characteristics and degrees of irrigation coverage.

The nozzle housing 42 also preferably includes at least three lands 76 directed inwardly from the ledge 70. The lands 76 are positioned roughly equidistantly from one another (preferably about 90 degrees from one another) so that a land 76 may engage and seal the valve sleeve 16 at an end 55 of shutter 54. In addition, the nozzle housing 42 preferably includes its own edge fins (or walls) 78 that are aligned with the edge fins 58 of the valve sleeve 16 when in one of the four settings. As explained further below, these four settings correspond to side strip, left strip, right strip, and shut-off configurations. In other words, in these four settings, the valve sleeve 16 and nozzle housing 42 are oriented with respect to one another to allow side strip irrigation, left strip irrigation, right strip irrigation, or no irrigation.

FIGS. 8A-D and 9A-D show the alignment of the valve sleeve 16 and nozzle housing 42 in different strip settings when viewed from above. In each of FIGS. 8A-D, the position of the middle edge fin 58B is shown to indicate the orientation of the valve sleeve 16 relative to the nozzle housing 42. In FIG. 8B, the valve sleeve 16 and nozzle housing 42 are in a side strip setting, in which the shutter 54 of the valve sleeve 16 is on the opposite side from the six flow channels 74 of the nozzle housing 42, and the middle edge fin 58B is in a twelve o'clock position. In this setting, the nozzle 10 is at the midpoint of the top leg of a rectangular irrigation pattern (FIG. 9B).

This alignment creates a side strip pattern through the full alignment of the six flow channels 74 with the open underside portion of the valve sleeve 16. The outermost channels 74A allow a relatively large stream of fluid to be distributed laterally to the left and right sides of the figure. The configuration of innermost channels 74C reduces the radius of throw to the short leg of the rectangular strip. The resulting irrigation pattern is one in which a substantially large amount of fluid is directed laterally while a relatively small amount is directed in a forward direction, thereby resulting in a substantially rectangular irrigation pattern with the nozzle 10 at the midpoint of the top horizontal leg (FIG. 9B).

In FIG. 8C, the valve sleeve 16 and nozzle housing 42 are in a right strip setting. As can be seen in the figure, the valve sleeve 16 has been rotated about 90 degrees clockwise from the side strip setting. The user rotates the deflector 12 (in engagement with the valve sleeve 16) about 90 degrees, and the middle edge fin 58B is in a three o'clock position. In this setting, the shutter 54 blocks three of the flow channels 74, while the other three flow channels 74 remain unblocked. In other words, half of the shutter 54 overlaps three of the flow channels 74 in which the bottom of the shutter 54 is upstream of the inlets 73 of the three flow channels 74. In this orientation, the nozzle 10 irrigates a rectangular strip that extends to the right of the nozzle 10 and may cover one half of the irrigation area of the side strip configuration (FIG. 9C).

In FIG. 8A, the valve sleeve 16 and nozzle housing 42 are in a left strip setting. As can be seen in the figure, the valve sleeve 16 has been rotated about 90 degrees counterclockwise from the side strip setting to the left strip setting, and the middle edge fin 58B is in a nine o'clock position. The user again rotates the deflector 12 (in engagement with the valve sleeve 16) about 90 degrees. In this setting, the shutter 54 blocks three of the flow channels 74 (the ones that were unblocked in the right strip setting). Again, half of the shutter 54 overlaps three of the flow channels 74 such that the bottom of the shutter 54 is upstream of the inlets 73 of the three flow channels 74. The nozzle 10 irrigates a rectangular area to the left of the nozzle 10 (FIG. 9A), which again may be one half of the area covered by the side strip orientation.

In FIG. 8D, the valve sleeve 16 has been rotated 180 degrees from the side strip setting. In this shut-off setting, the shutter 54 is fully aligned with the six flow channels 74, and the middle edge fin 58B is in a six o'clock position. In other words, the roughly 180 degree shutter 54 is aligned with the roughly 180 degrees defined by the six flow channels 74 to block fluid flow to the six flow channels 74. The bottom of the shutter 54 is upstream of the six flow channels 74 so that, in this setting, there is no irrigation by nozzle 10 (FIG. 9D). Such a shut-off setting may be desirable, for example, where there are multiple nozzles 10 that are arranged on terrain with one source supplying fluid to all of the nozzles 10, and the user only wants to allow some of them to irrigate (possibly to install other nozzles).

Figure 10:
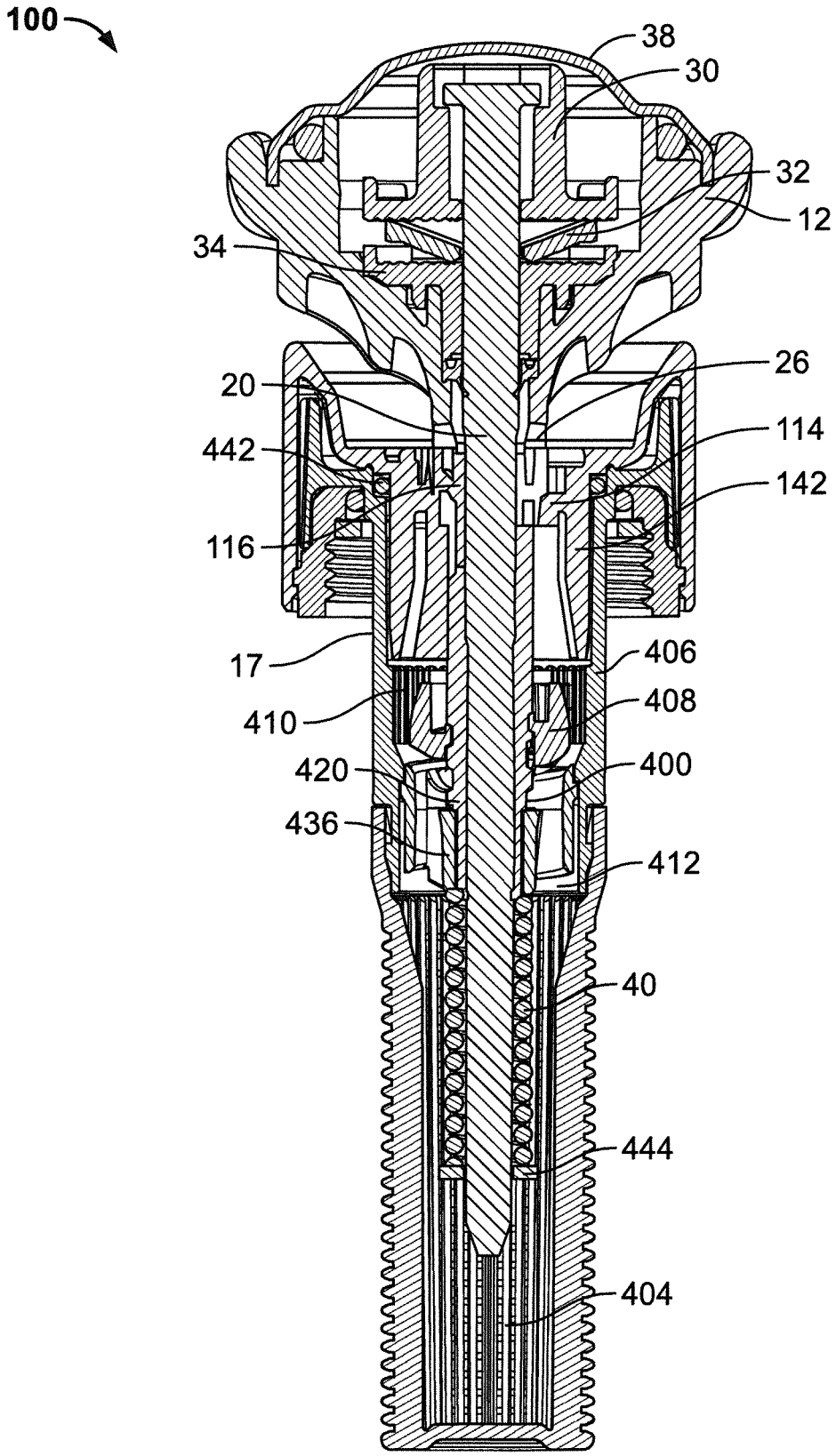
FIG. 10 is a cross-sectional view of a second embodiment of a nozzle embodying features of the present invention.

A second embodiment (nozzle 100) is shown in FIG. 10. In this preferred form, the valve sleeve 116 is not rotatable, and the nozzle 100 is not adjustable between multiple strip settings. In other words, in this form, the valve sleeve 116 and the nozzle housing 142 remain fixed relative to one another and define a specific strip irrigation pattern. The two components or bodies (valve sleeve 116 and nozzle housing 142) collectively define a non-adjustable pattern template 114, rather than a pattern adjustment valve. In this form, it is contemplated that there are three separate distinct models of nozzle 100 that produce three distinct strip irrigation patterns, i.e., a side strip pattern, a left strip pattern, and a right strip pattern.

Generally, the components of the nozzle 100 are similar in many ways to that described above in the first embodiment, but the structure and operation of the valve sleeve 116 and nozzle housing 142 have been modified. The nozzle housing 142 still includes a cylindrical recess that receives and supports the valve sleeve 116 therein, but the valve sleeve 116 is not rotatable therein. The nozzle housing 142 also still has a central hub 164 that defines a central bore 166 for receiving the shaft 20, and similarly, the valve sleeve 116 has a central hub 160 that defines a central bore 161 for receiving the shaft 20.

In this second preferred form, it is contemplated that there may be three different sets of nozzle housings 142 and valve sleeves 116 to produce a side strip pattern, a left strip pattern, and a right strip pattern. More specifically, the combination of nozzle housing 142A and valve sleeve 116A (FIGS.

11-14) produces the side strip pattern, nozzle housing 142B and valve sleeve 116B (FIGS. 15 and 16) produce the right strip pattern, and nozzle housing 142C and valve sleeve 116C (FIGS. 17 and 18) produce the left strip pattern.

First, the nozzle housing 142A and valve sleeve 116A for producing side strip irrigation are shown in FIGS. 11-14. In this form, the nozzle housing 142A includes six flow channels 174 that are preferably the same or similar in structure to those described for the first embodiment. These six flow channels 174 extend about 180 degrees about the central hub 164, include two sets of three flow channels 174A, 174B, and 174C that are mirror images of one another. In this preferred form, the upstream inlets are again staggered at different upstream heights and in terms of inlet sizes, but the downstream exits are generally at the same radial positions. More specifically, the two outermost flow channels 174A extend the furthest upstream (defining the largest inlet with the valve sleeve 116A), while the two innermost flow channels 174C extend the least upstream (defining the smallest inlet with the valve sleeve 116A). Again, the three flow channels 174A, 174B, and 174C are staggered in terms of inlet size, but, in other forms, it is contemplated that this may be accomplished without staggering the inlet height. However, in this preferred form, the flow channel walls 171A, 171B, 171C, and 171D defining the flow channels 174A, 174B, and 174C from one another are preferably staggered at different downstream heights (FIGS. 13A-13C). More specifically, in this preferred form, the outermost wall 171A extends the furthest downstream from the flow channel inlet, while the innermost wall 171D extends the least distance downstream. This staggered approach changes the lengths of the three flow channels 174A, 174B, and 174C with the outermost flow channel 174A being the longest and the innermost flow channel 174C being the shortest, which may fine tune the filling in of the strip irrigation pattern. As with the first embodiment (nozzle 10), it should be understood that the structure and positions of the upstream inlets, downstream exits, and/or contours of the flow channels 174 may be customized, as appropriate, to modify the flow characteristics and irrigation coverage of nozzle 100.

The nozzle housings 142A, 142B, 142C also each preferably have a circumferential ledge 170 to provide support and sealing to the valve sleeves 116A, 116B, 116C. As can be seen, the ledge 170 does not extend along the entire circumference but extends approximately 180 degrees about the circumference, and the nozzle housings 142A, 142B, 142C also each preferably include interrupted step portions 172 that are generally co-planar with the ledge 170 and extend along the roughly 180 degrees opposite the ledge 170. These step portions 172 also support and seal the valve sleeves 116A, 116B, 116C. The co-planar ledge 170 and step portions 172 collectively define a sealing surface 169 between nozzle housings 142A, 142B, 142C and valve sleeves 116A, 116B, 116C, respectively, that limits upward flow of fluid other than through flow channels 174.

The nozzle housing 142A includes other features that are different in structure and/or function than the nozzle housing 42 of the first embodiment, such as support surface 168, detents 176, and edge fins (or walls) 178. For example, the support surface 168 is generally annular in shape (and not an undulating surface) because the valve sleeve 116A does not rotate to different settings. The two detents 176 are intended to fix the valve sleeve 116 in place relative to the nozzle housing 142A. They are spaced a certain distance apart to define a recess 177 to allow insertion of a corresponding key-like feature of the valve sleeve 116A therein, which is described below. The edge fins (or walls) 178 define edges of fluid flowing up through an arcuate slot 179 in the nozzle housing 142A and through the outermost flow channels 174A.

Figure 11:
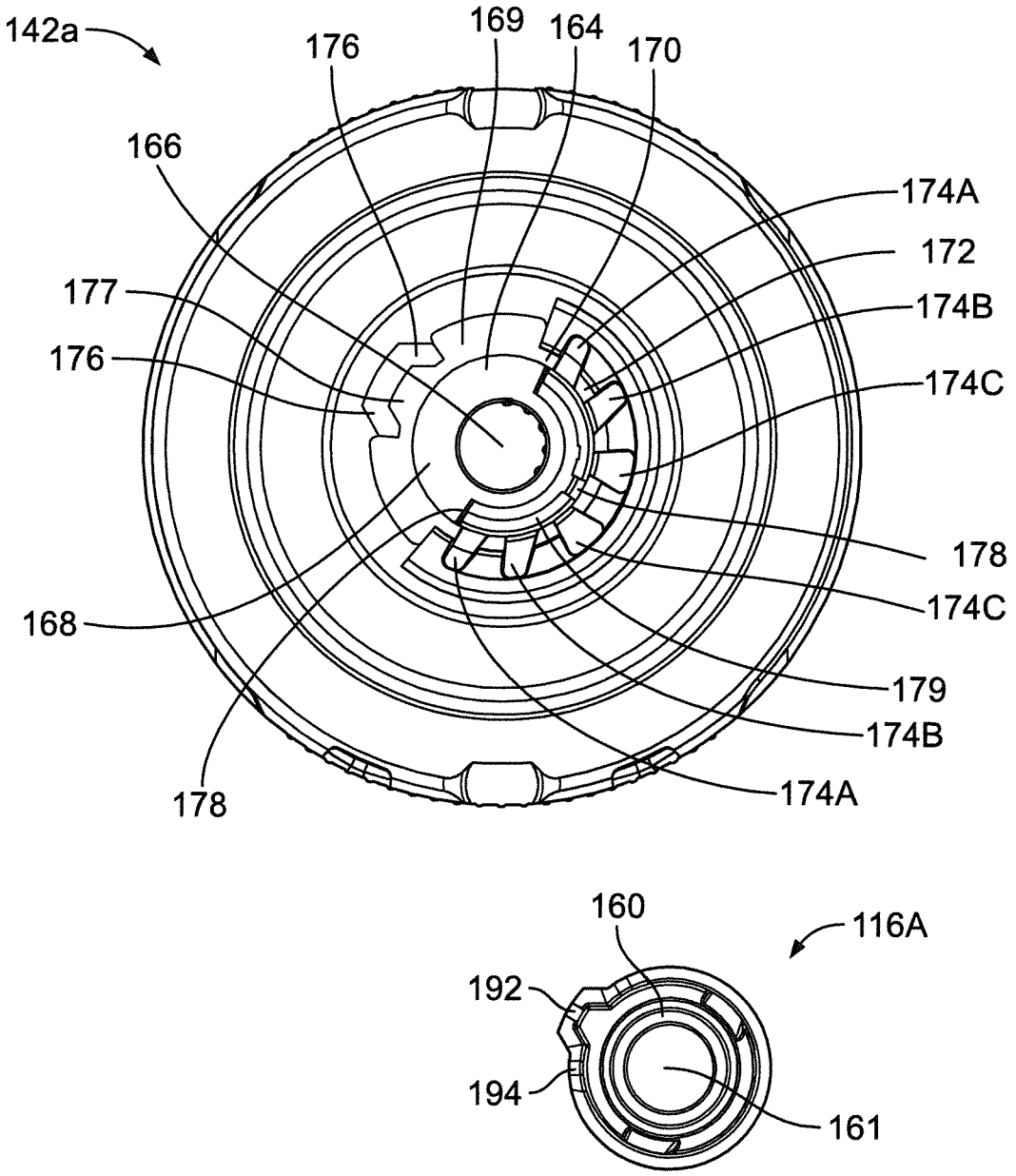
FIG. 11 is a top plan view of the unassembled valve sleeve and nozzle housing of the nozzle of FIG. 10 for side strip irrigation.
Figure 12:
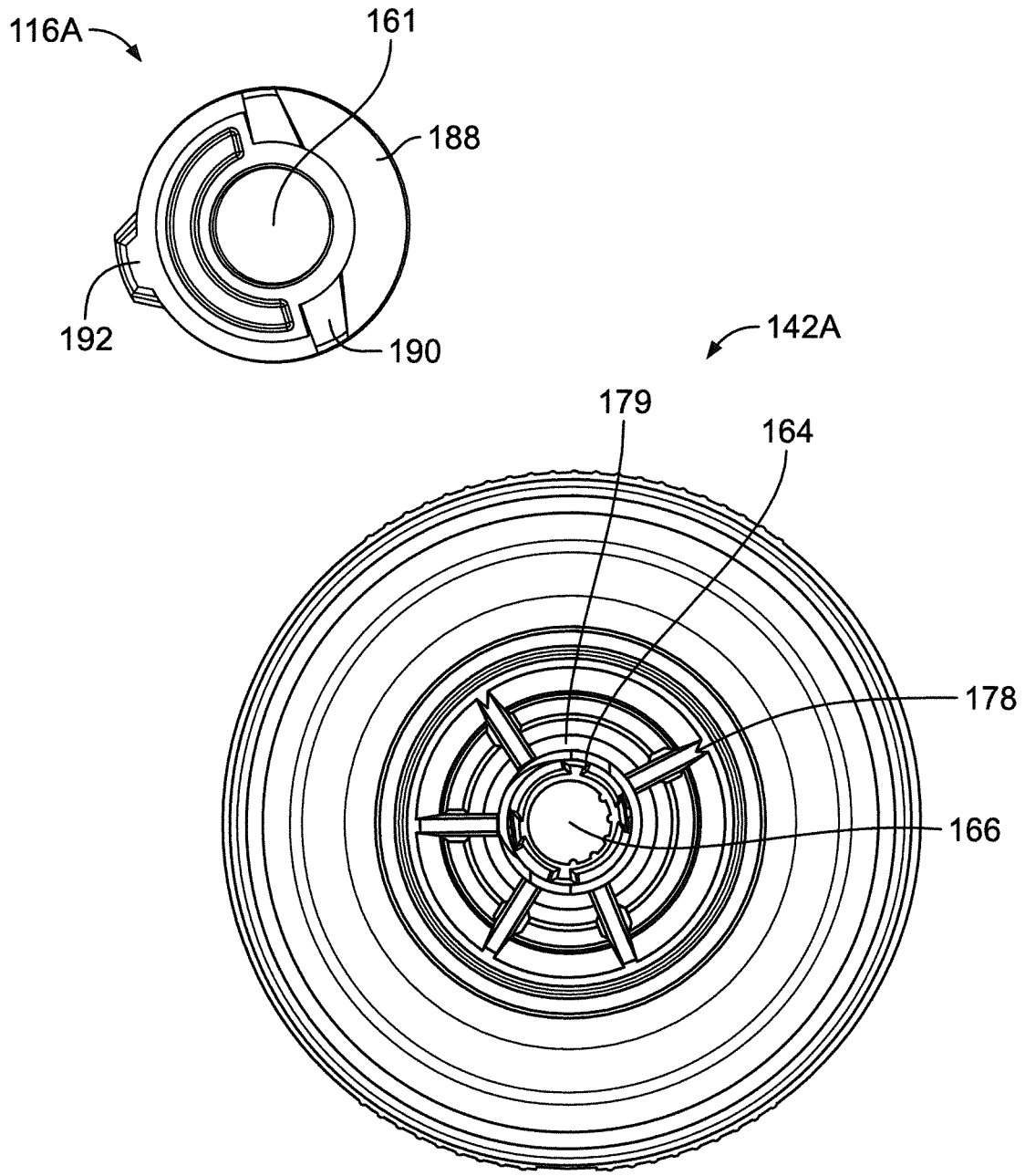
FIG. 12 is a bottom plan view of the unassembled valve sleeve and nozzle housing of the nozzle of FIG. 10 for side strip irrigation.
Figure 13A:
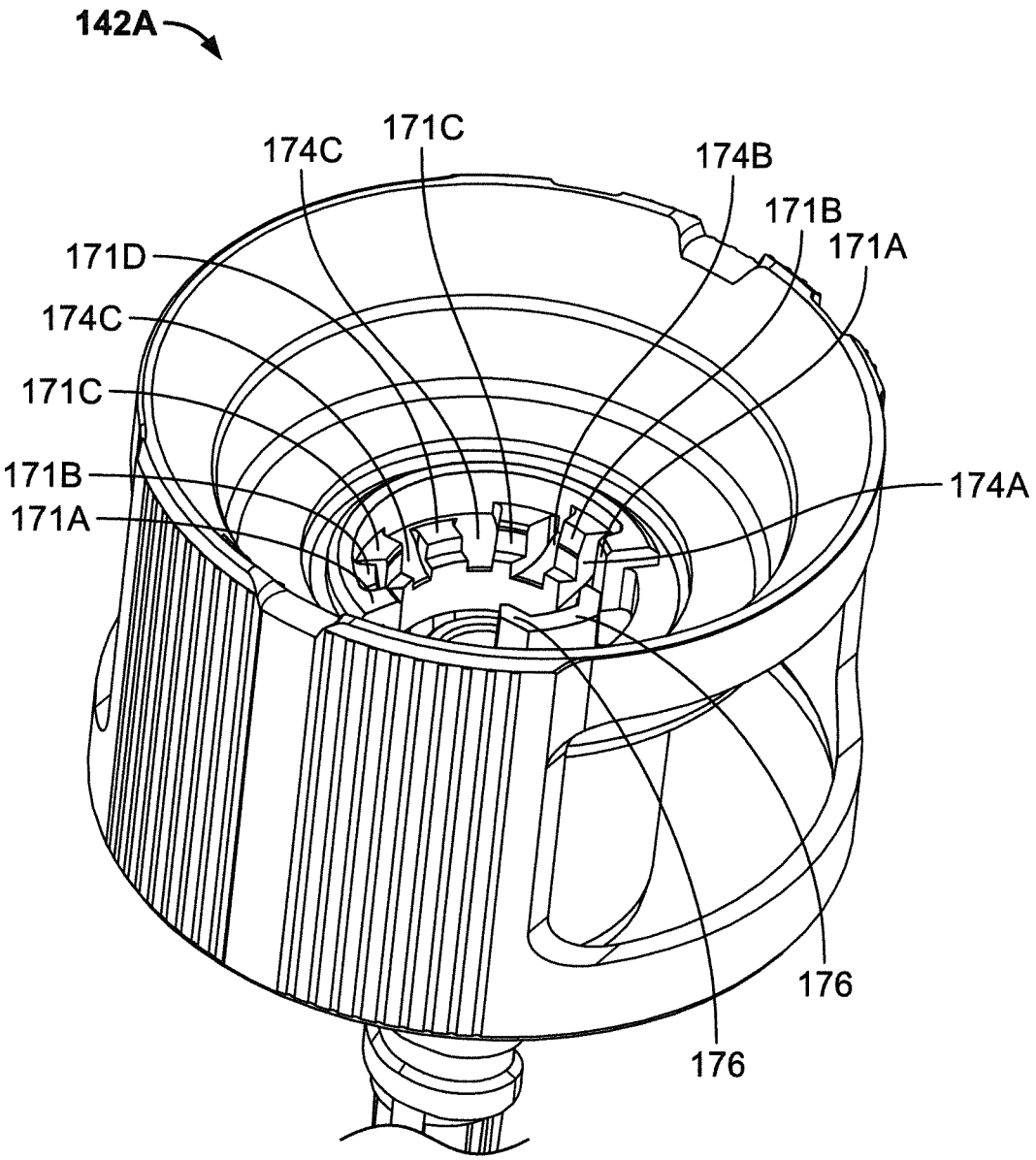
FIG. 13A is a perspective view of a portion of the nozzle housing of the nozzle of FIG. 10.
Figure 13B:
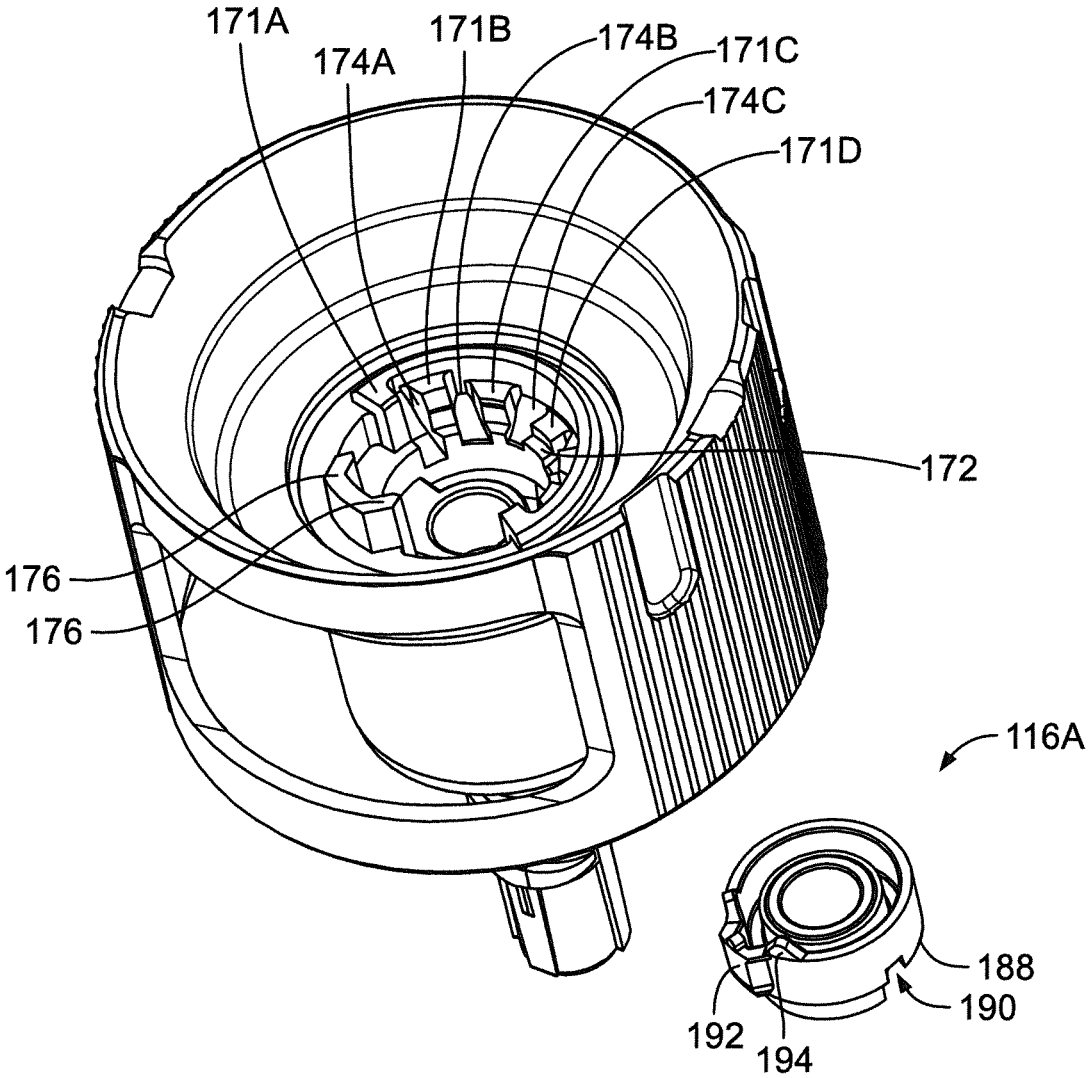
FIG. 13B is a perspective view of the nozzle housing and valve sleeve of the nozzle of FIG. 10.
Figure 13C:
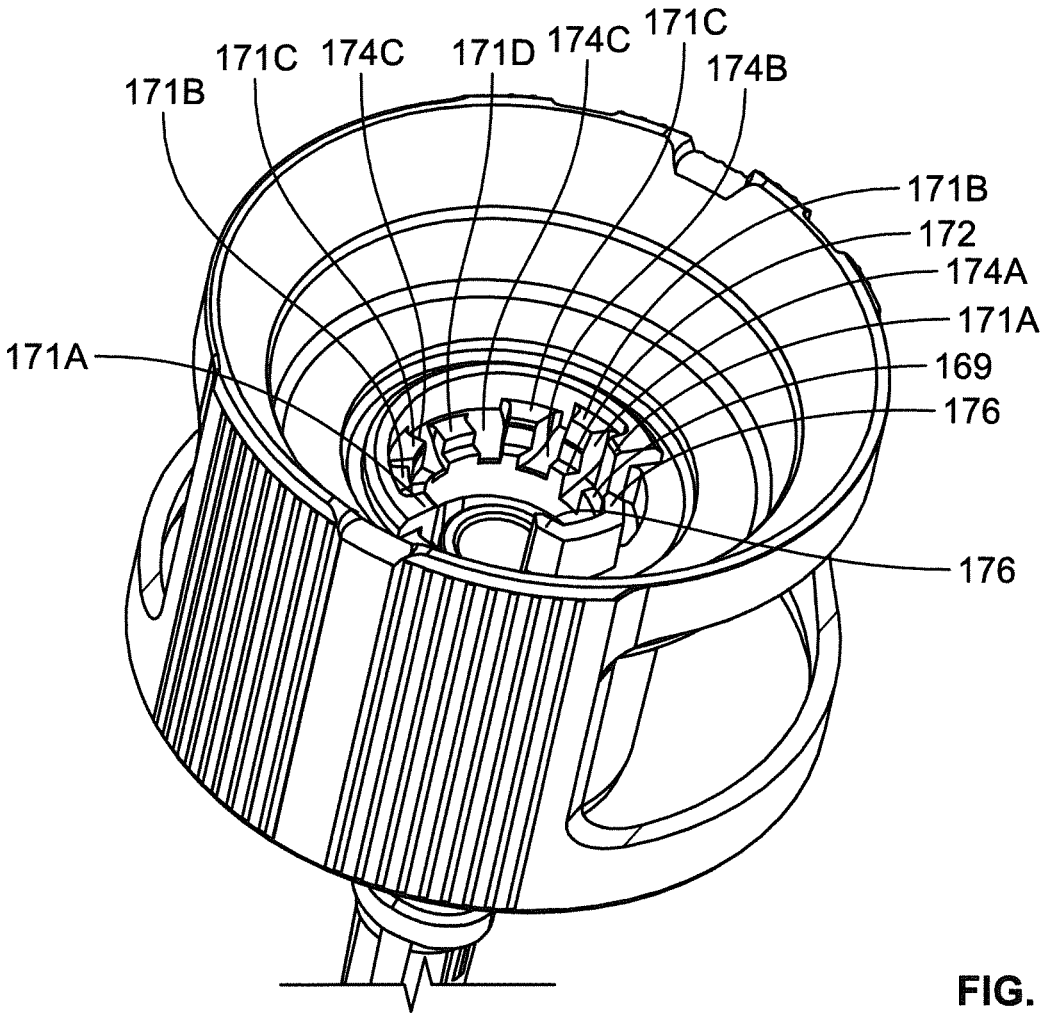
FIG. 13C is a perspective view of a portion of the nozzle housing of the nozzle of FIG. 10.
Figure 14:
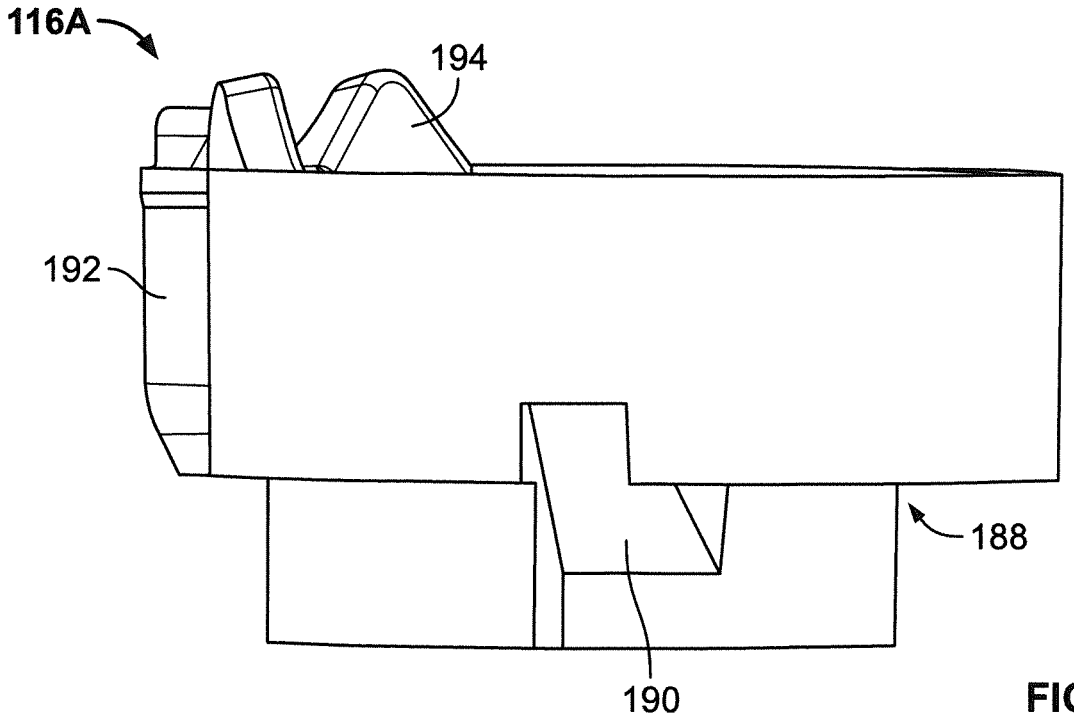
FIG. 14 is a side elevational view of the valve sleeve of the nozzle of FIG. 10.

The valve sleeve 116A is shown in FIGS. 11, 12, and 14. As can be seen, on the underside of the valve sleeve 116, there is a recessed 180 degree portion 188 that corresponds to the six flow channels 174 of the nozzle housing 142. The recessed portion 188 preferably includes two notches 190 that are positioned to correspond to the positions of the outermost flow channels 174A in the nozzle housing 142A. The notches 190 allow more flow to the outermost flow channels 174A to help fill in the most distant portions of the rectangular irrigation pattern.

The valve sleeve 116A is held in a fixed position within the nozzle housing 142A. More specifically, the valve sleeve 116A includes a boss 192 that acts as a key to fit in the corresponding recess 177 of the nozzle housing 142A to lock the valve sleeve 116A in place with respect to the nozzle housing 142A. In the side strip orientation shown above, the six flow channels 174 of the nozzle housing 142 are aligned with the recessed 180 degree portion 188 on the underside of the valve sleeve 116 to define a roughly 180 degree pattern.

As can be seen, the valve sleeve 116A preferably includes two teeth (or drive locks 194) that are received within two recesses between corresponding teeth 26 of the deflector 12. These drive locks 194 are not used to rotate the valve sleeve 116A to different settings relative to the nozzle housing 142A (as in the first embodiment) because the valve sleeve 116A is fixed, and not rotated, in the second embodiment. However, the drive locks 194 are received within recesses between teeth 26 of the deflector 12 so that a user can install the nozzle 100 by pushing down on the deflector 12 to engage the valve sleeve 116A. The user can then rotate the deflector 12 to rotate the valve sleeve 116A and the rest of nozzle body 17, including nozzle base 438 (FIG. 2). This rotation allows the user to thread the nozzle 100 directly onto the riser of an associated spray head (rather than using a tool to lift the riser and install the nozzle 100).

In an alternative form, it is contemplated that the nozzle housing 142A can include modifications to the six flow channel 174 structure described above. For example, it is contemplated that the nozzle housing 142A can use six flow channels 174 in which the upstream inlets are not staggered in height, i.e., they are generally at the same height. In this alternative form, it is contemplated that the underside of the valve sleeve 116 might include stepped notches 190 increasing in depth as one proceeds from the innermost flow channel 174C to the outermost flow channel 174A. In other words, the adjustment of flow through the flow channels 174 may be controlled by staggered structure in the nozzle housing 142 (such as flow channels with staggered inlet height) and/or by staggered structure in the underside of the valve sleeve 116 (such as with stepped notches). This alternative structure can be used also for the nozzle housing and valve sleeve structure for left and right strip irrigation.

As described above, FIGS. 11-14 show the second embodiment in a side strip setting resulting in a side strip irrigation pattern (FIG. 9B). For example, in one form, the side strip pattern may constitute a 5 foot by 30 foot rectangle. By reducing the number of flow channels to three flow channels extending about 90 degrees in the nozzle housing 142, the nozzle 100 can be configured for two other rectangular irrigation patterns, i.e., left strip and right strip patterns, as described further below. In other words, there are three nozzle models where the number and arrangement of flow channels in the nozzle housing is different to achieve different strip patterns.

Figure 15:
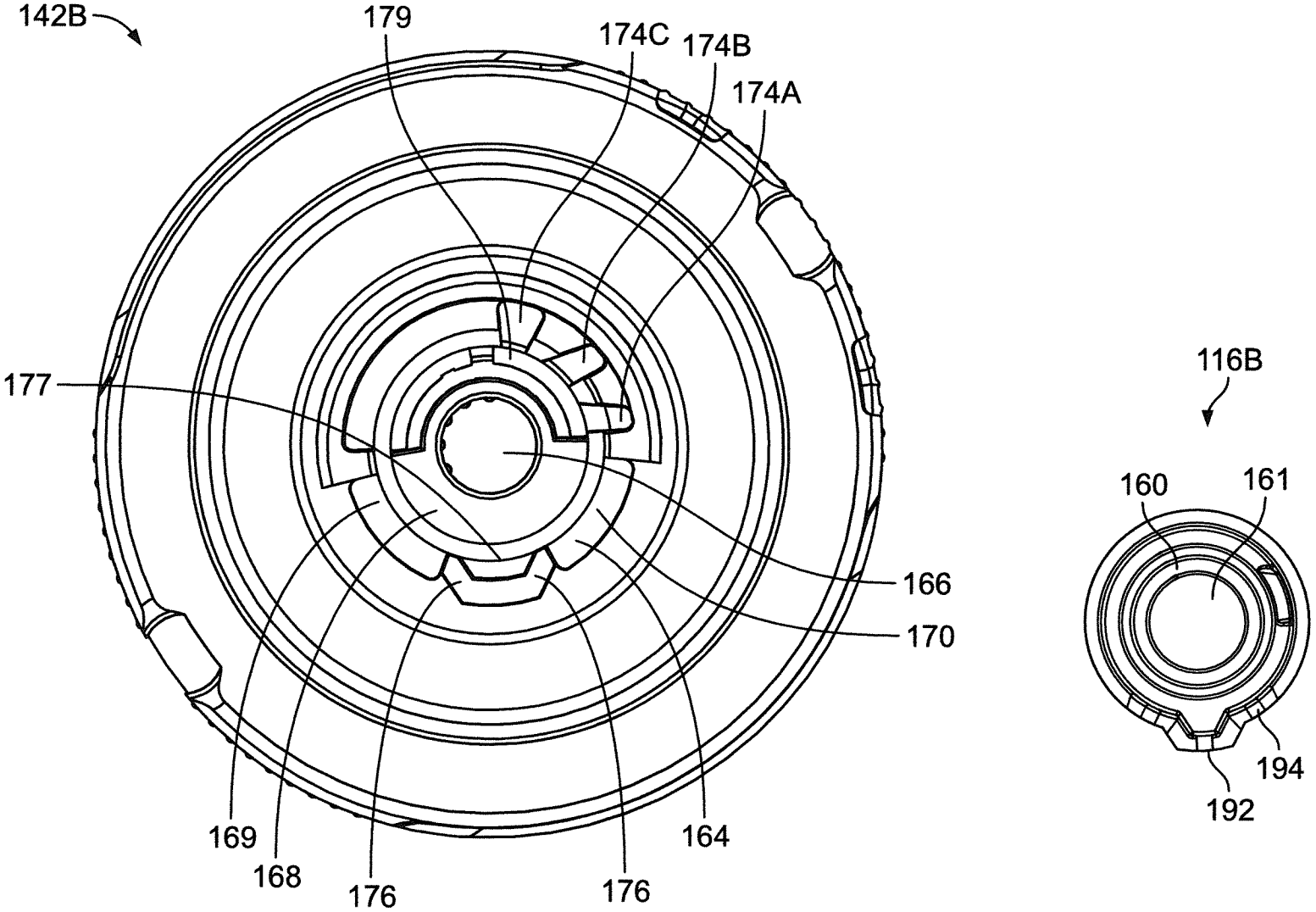
FIG. 15 is a top plan view of an alternative unassembled form of valve sleeve and nozzle housing of the nozzle of FIG. 10 for right strip irrigation.
Figure 16:
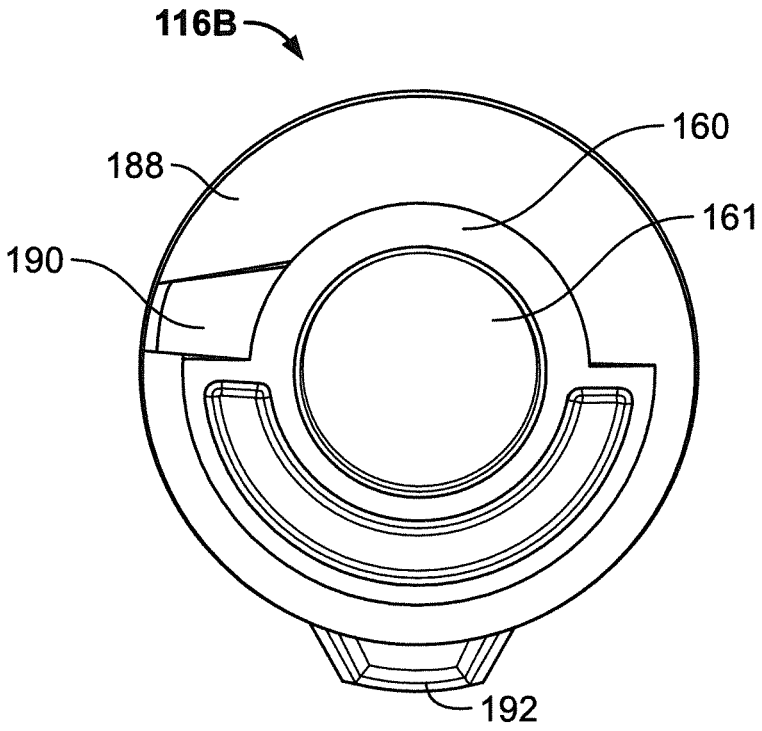
FIG. 16 is a bottom plan view of an alternative form of the valve sleeve of the nozzle of FIG. 10 for right strip irrigation.

FIGS. 15 and 16 show modified valve sleeve 116B and modified nozzle housing 142B to achieve a right strip setting resulting in a right strip irrigation pattern (FIG. 9C). For example, in one form, the right strip pattern may constitute a 5 foot by 15 foot rectangle. As can be seen, the nozzle housing 142B only includes three flow channels that will fill in only the right strip half of the irrigation pattern (FIG. 9C). In this form, the nozzle housing 142B preferably includes flow channels 174 with upstream inlets that are staggered in height to cooperate with the valve sleeve 116B (like those shown in FIGS. 7A-7C and FIGS. 13A-13C). As can be seen, the valve sleeve 116B has been modified to include only one notch 190 corresponding to the single outermost flow channel 174A (although the same valve sleeve 116A could also be used).

Figure 17:
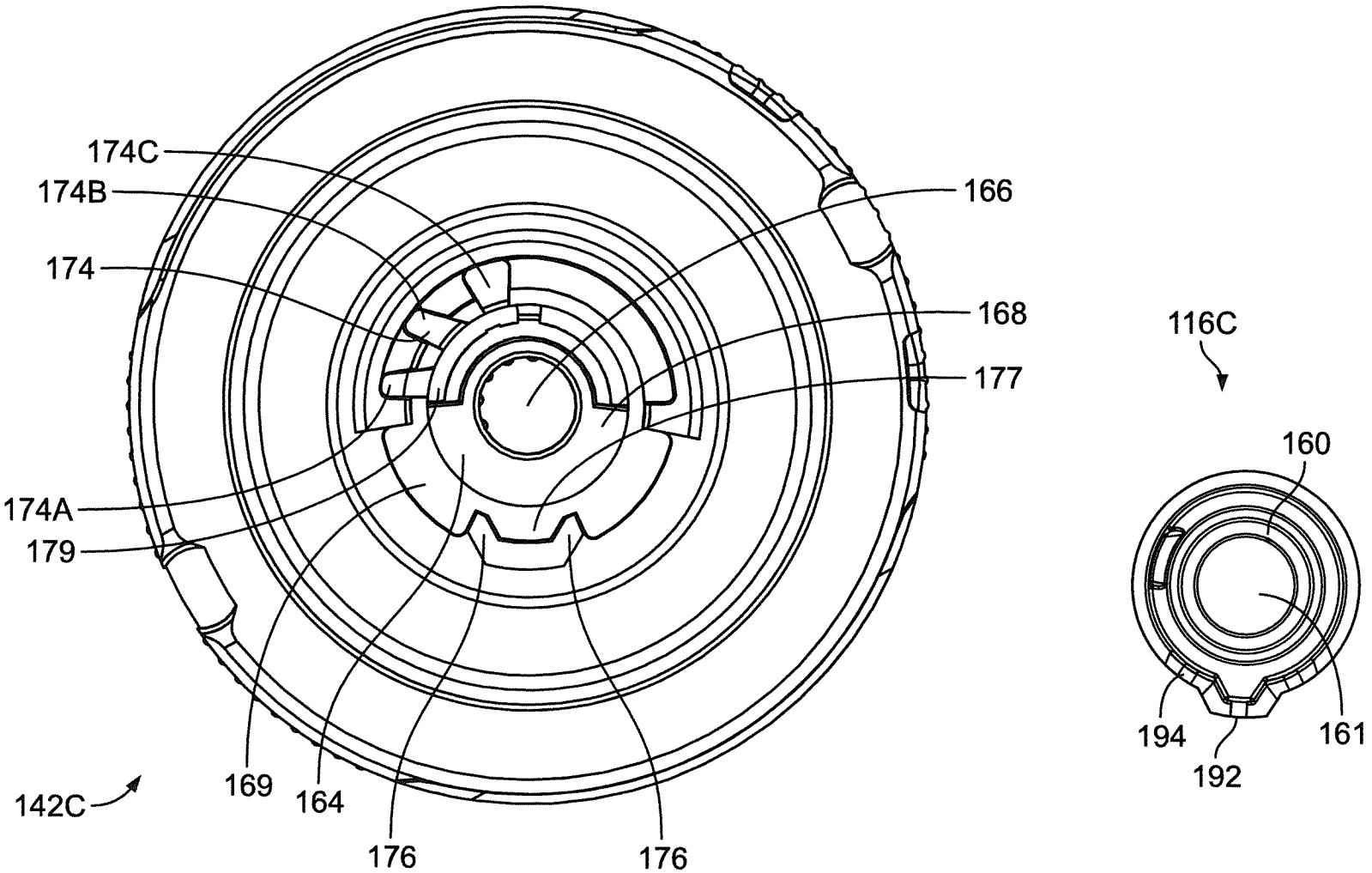
FIG. 17 is a top plan view of an alternative unassembled form of valve sleeve and nozzle housing of the nozzle of FIG. 10 for left strip irrigation.
Figure 18:
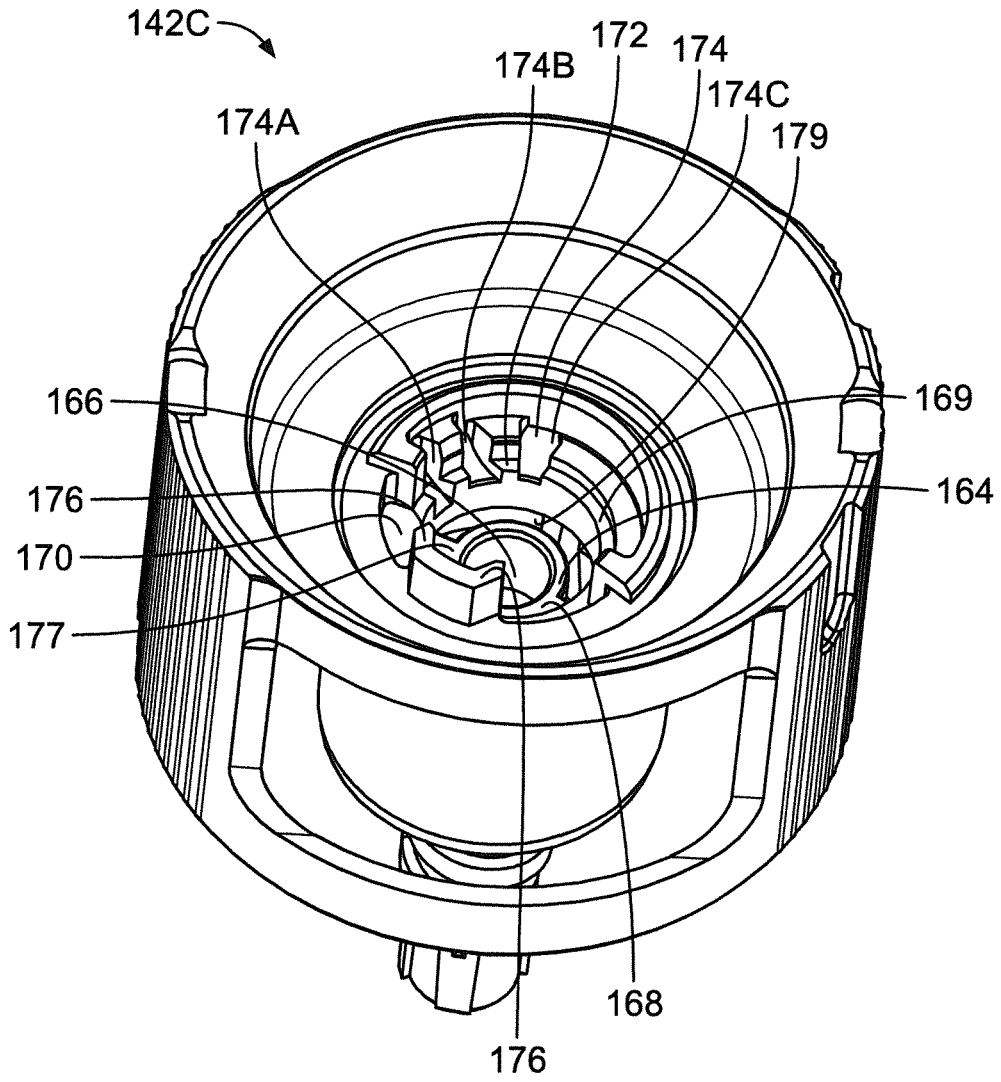
FIG. 18 is a is a perspective view of a portion of the nozzle housing of the nozzle of FIG. 10 for left strip irrigation.

FIGS. 17 and 18 show modified valve sleeve 116C and modified nozzle housing 142C to achieve a left strip setting resulting in a left strip irrigation pattern (FIG. 9A). In one form, the left strip pattern may constitute a 5 foot by 15 foot rectangle. As can be seen, the nozzle housing 142C only includes three flow channels that will fill in only the left strip half of the irrigation pattern (FIG. 9A), and these three flow channels are the opposite of the ones used for right strip irrigation. In this form, the nozzle housing 142C preferably includes flow channels 174 with upstream inlets that are staggered in height to cooperate with the valve sleeve 116C (like those shown in FIGS. 7A-7C and FIGS. 13A-13C). The valve sleeve 116C has been modified to include only one notch 190 that is generally on the opposite side from the notch 190 used for right strip irrigation (see FIG. 16), although the valve sleeve 116A could also be used.

It is also contemplated that the nozzle housing 142A might be used as a common nozzle housing to also achieve left and right strip irrigation by shifting the orientation of the valve sleeve 116 and nozzle housing 142A relative to one another. More specifically, it is contemplated that the nozzle housing 142A and valve sleeve 116 might be used but with the boss 192 of the valve sleeve 116 acting as a key re-positioned 90 degrees, i.e., clockwise or counterclockwise, so that the orientation of nozzle housing 142A to valve sleeve 116 is shifted 90 degrees. In other words, the nozzle housing 142A and valve sleeve 116 may be used to produce left or right strip patterns by fixing the orientation of the assembled nozzle housing 142A and valve sleeve 116 at either 90 degrees clockwise or counterclockwise from the side strip orientation shown in FIG. 11.

In the first and second embodiments, the two valve bodies (nozzle housing and valve sleeve) used either three flow channels or six flow channels. More specifically, in the first embodiment, the nozzle housing 42 included six flow channels (two mirror image sets of three flow channels), and the valve sleeve 16 could be rotated to four different settings. In the second embodiment, the nozzle housing 142A included six flow channels for side strip irrigation, and the nozzle housings 142B and 142C included three flow channels for either right or left strip irrigation, respectively. However, this disclosure is not limited to any particular number of flow channels.

Figure 26:
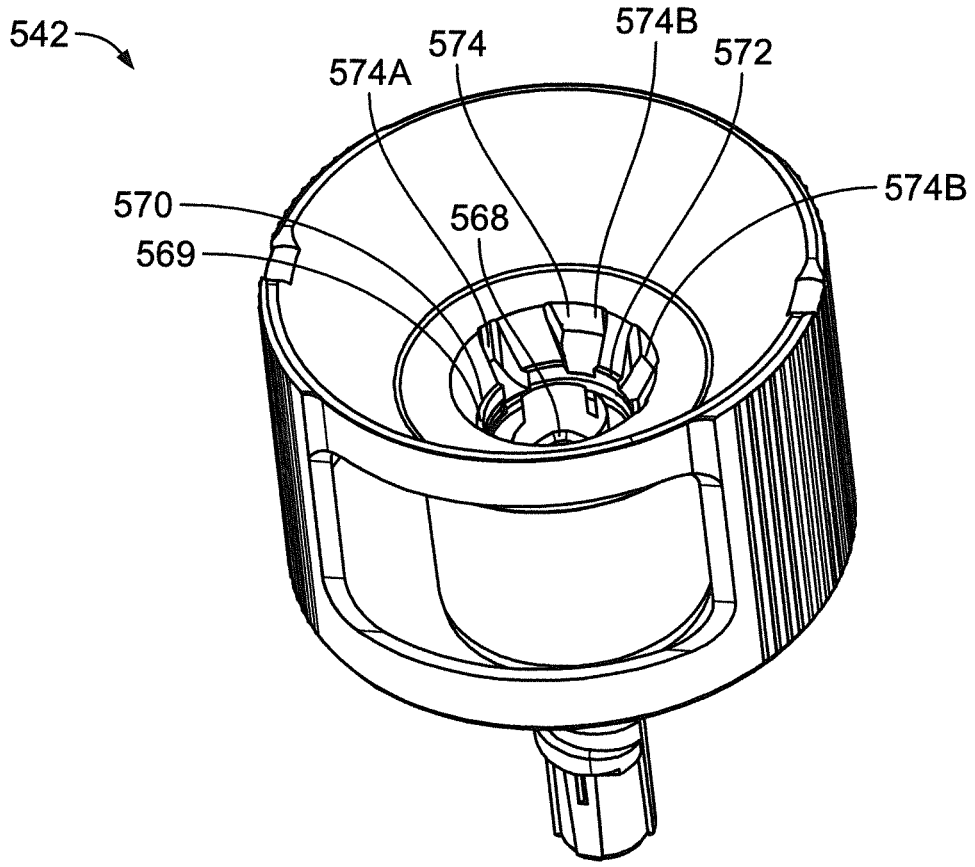
FIG. 26 is a perspective view of an alternative form of a nozzle housing having four flow channels for use with the nozzle of FIG. 1.
Figure 27:
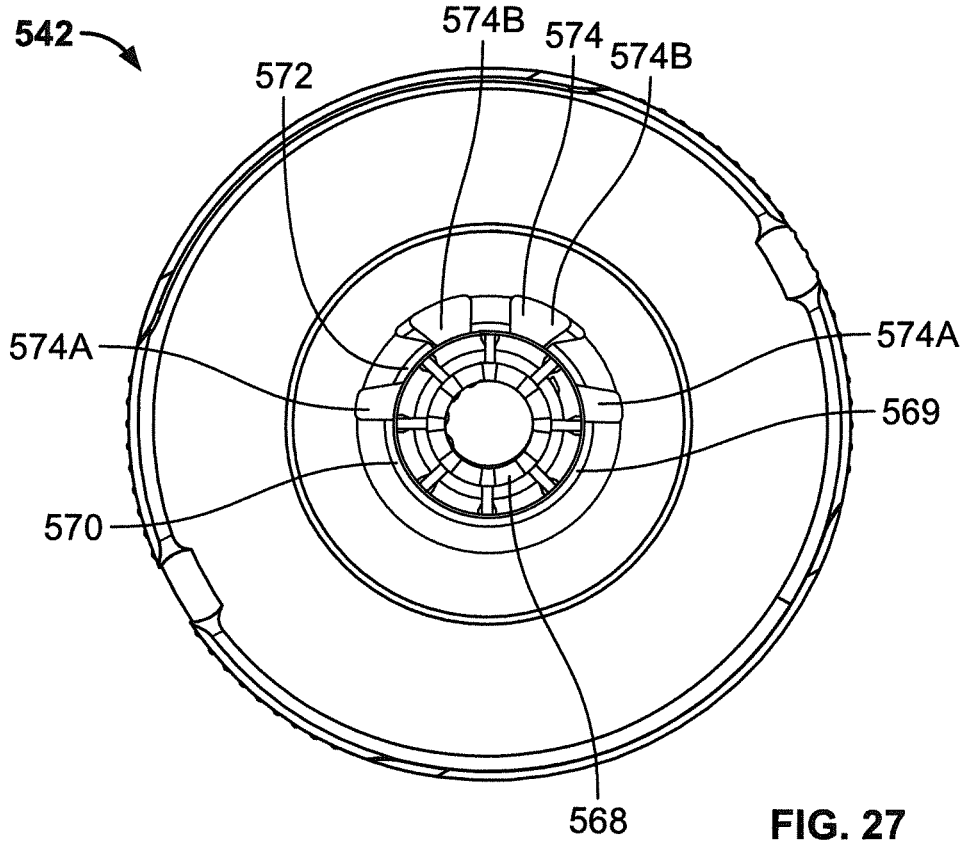
FIG. 27 is a top plan view of the nozzle housing of FIG. 26.

For example, as shown in FIGS. 26 and 27, there is shown a nozzle housing 542 for use with nozzle 10. This nozzle housing 542 includes a total of only four flow channels 574. It includes two sets of two flow channels 574A and 574B with each set generally being a mirror image of the other set with each set filling in half of the large rectangular irrigation pattern (when in the side strip setting). The two flow channels 574A and 574B of each set are preferably staggered so that their inlets are of different sizes, and their contours are different to reduce the energy and velocity of fluid flowing through the channels 574A and 574B in a different manner (as described above generally with respect to nozzle 42). In this manner, the outer flow channels 574A fill the more distant parts of the strip irrigation pattern, and the inner flow channels 574B fill the closer parts.

This nozzle housing 542 generally includes the other structure of nozzle housing 42 described above. Nozzle housing 542 includes an undulating support surface 568 that includes four sets of alternating elevated and depressed portions that complement corresponding portions on the bottom surface 52 of the valve sleeve 16. As addressed above, this support surface 568, in combination with the bottom surface 52 of the valves sleeve 16, defines four settings of the strip nozzle 10. It also has a circumferential ledge 570 and interrupted step portions 572 (that are generally co-planar with the ledge 570) to define a sealing surface 569.

Further, it should be understood that a modified four-channel nozzle housing may also be used in conjunction with the second embodiment (nozzle 100). In this form, the nozzle housing may include four flow channels for side strip irrigation (similar to those shown in FIGS. 26 and 27). In addition, in this form, the nozzle housing may be modified to include only one set of two flow channels for either right or left strip irrigation, respectively (similar to the nozzle housings 142A and 142B shown in FIGS. 15, 17, and 18).

In addition, as should be evident, this concept and arrangement of flow channels could be extended to other numbers of flow channels. In this preferred form, four flow channels are the minimum required number of flow channels for side strip irrigation (two sets of two flow channels with each set producing a long stream and a short stream), but nozzles with additional flow channels are also possible. Nozzles with additional flow channels would produce intermediate streams. For instance, the nozzle housing may be modified to include eight or more flow channels for side strip irrigation (two sets of four flow channels with each set producing a long stream, a short stream, and two intermediate streams). In this regard, the general approach is to create two essentially mirror image sets of flow channels with each set intended to fill in one half of a side strip rectangular pattern (or allowing fluid flow through only one set of flow channels to achieve right or left strip irrigation).

Figure 19:
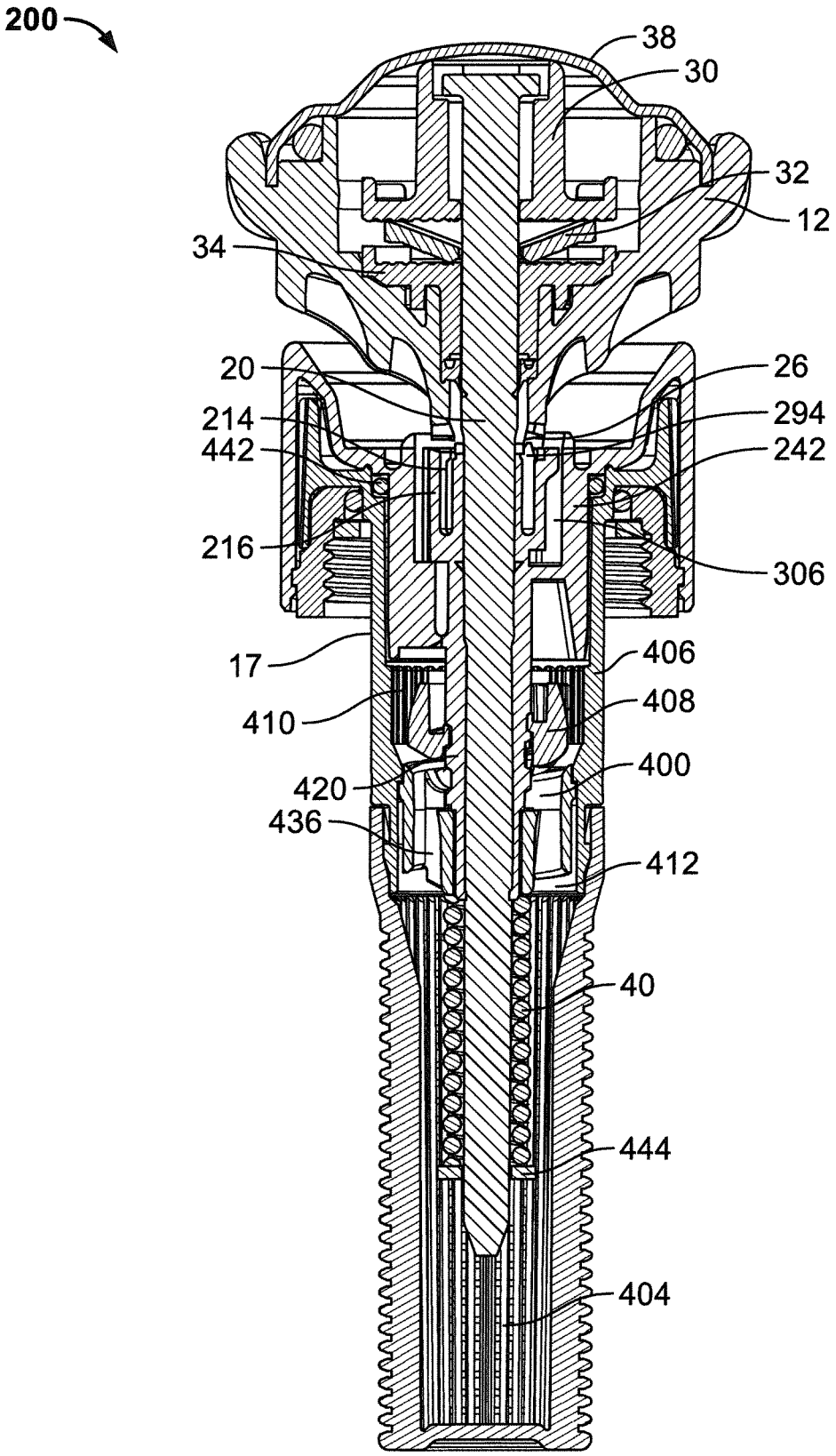
FIG. 19 is a cross-sectional view of a third embodiment of a nozzle embodying features of the present invention.
Figure 20:
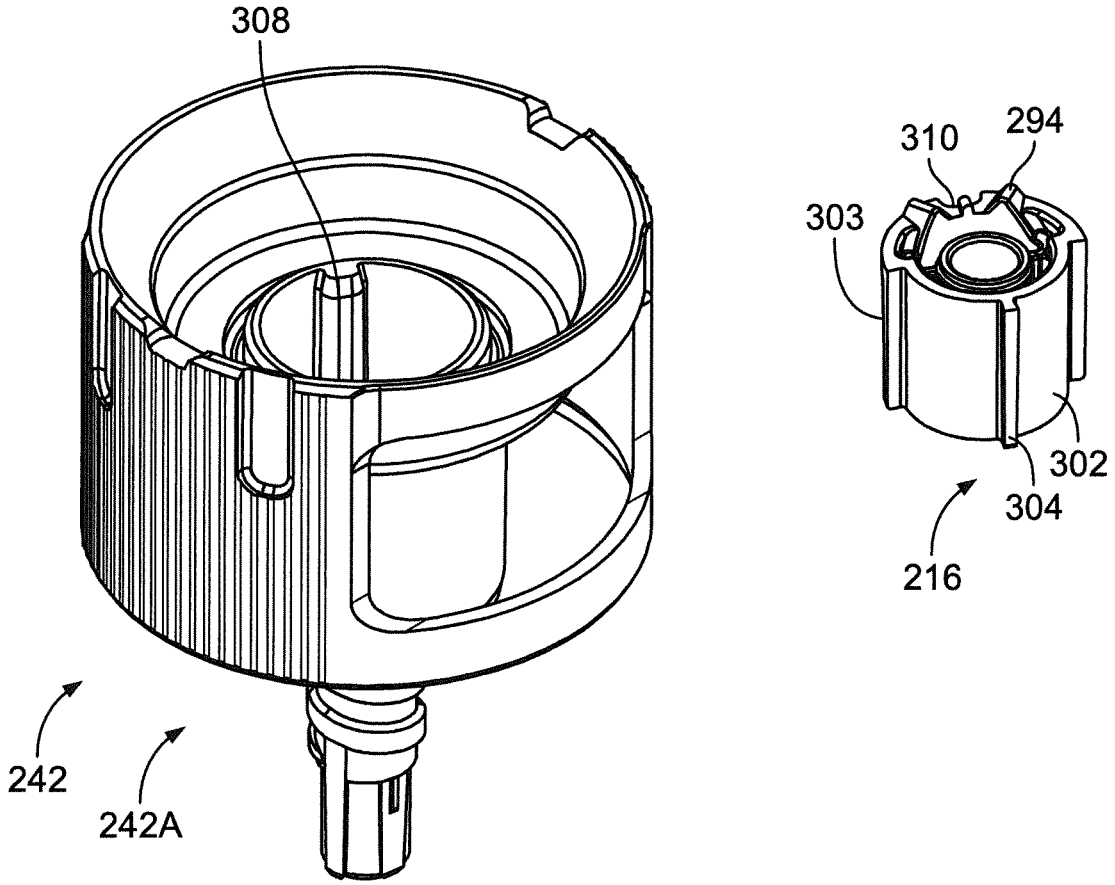
FIG. 20 is a perspective view of the unassembled nozzle housing and valve sleeve of FIG. 19 for side strip irrigation.
Figure 21:
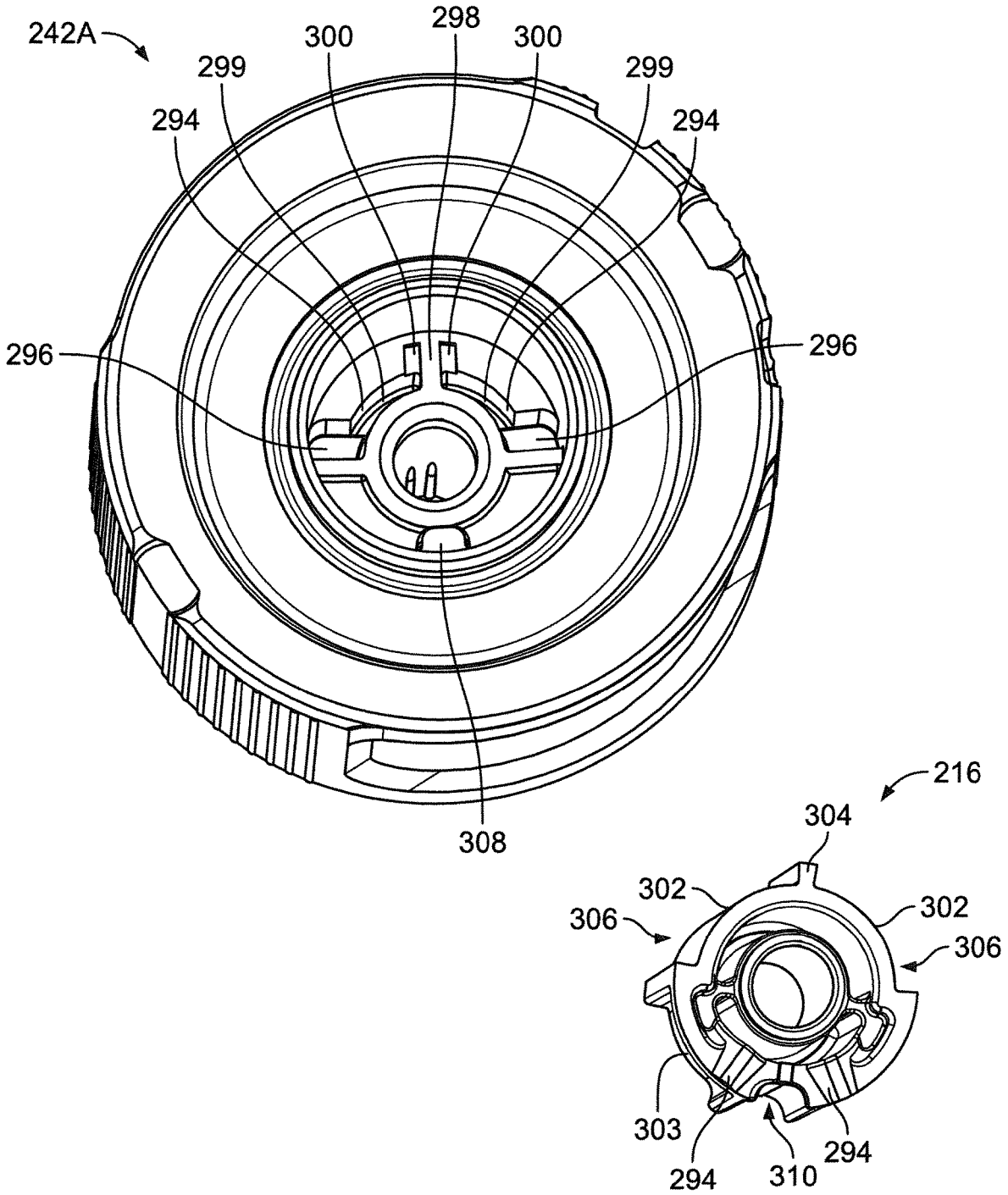
FIG. 21 is a top perspective view of the unassembled nozzle housing and valve sleeve of FIG. 19 for side strip irrigation.
Figure 22:
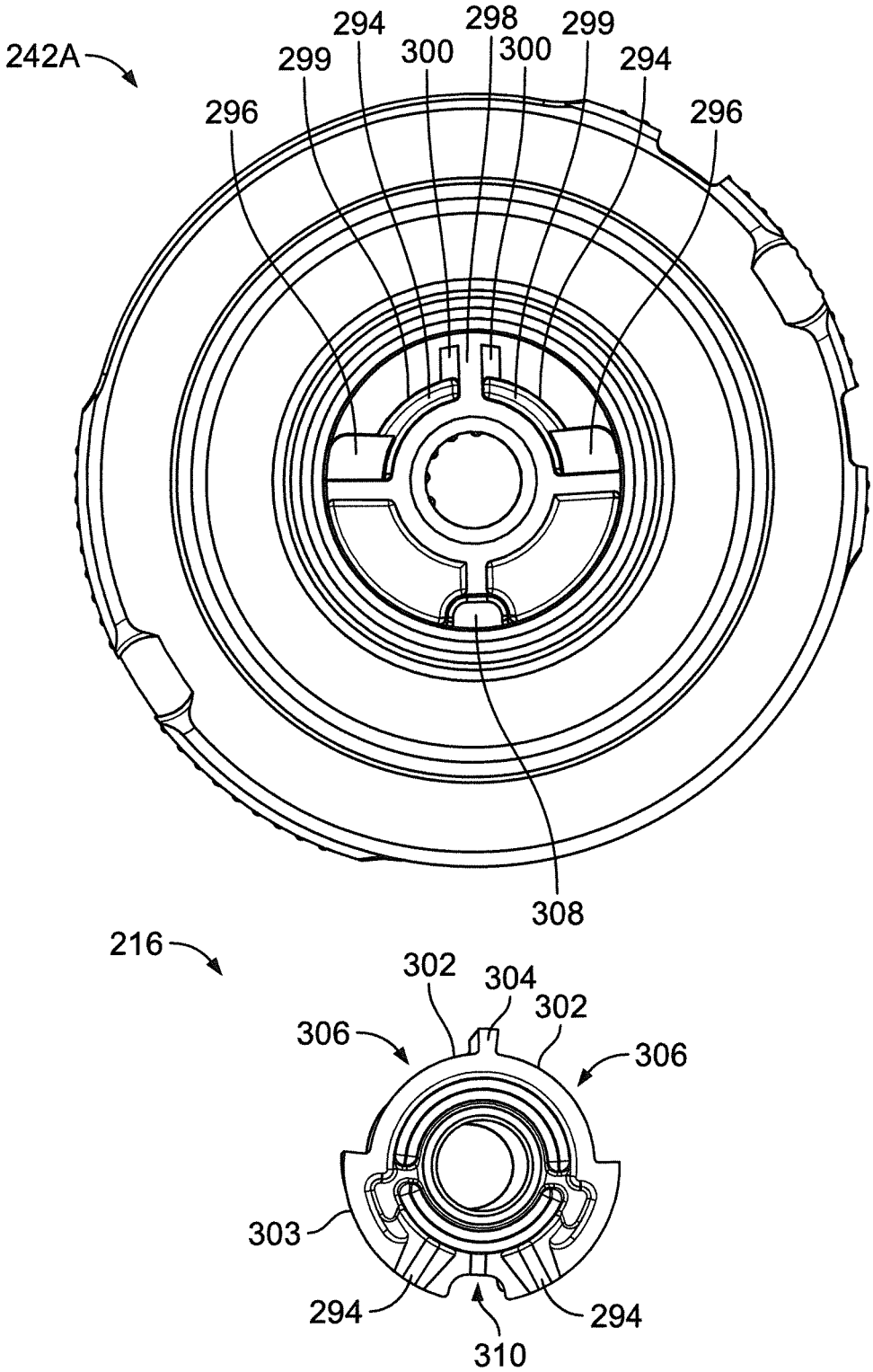
FIG. 22 is a top plan view of the unassembled nozzle housing and valve sleeve of FIG. 19 for side strip irrigation.
Figure 23:
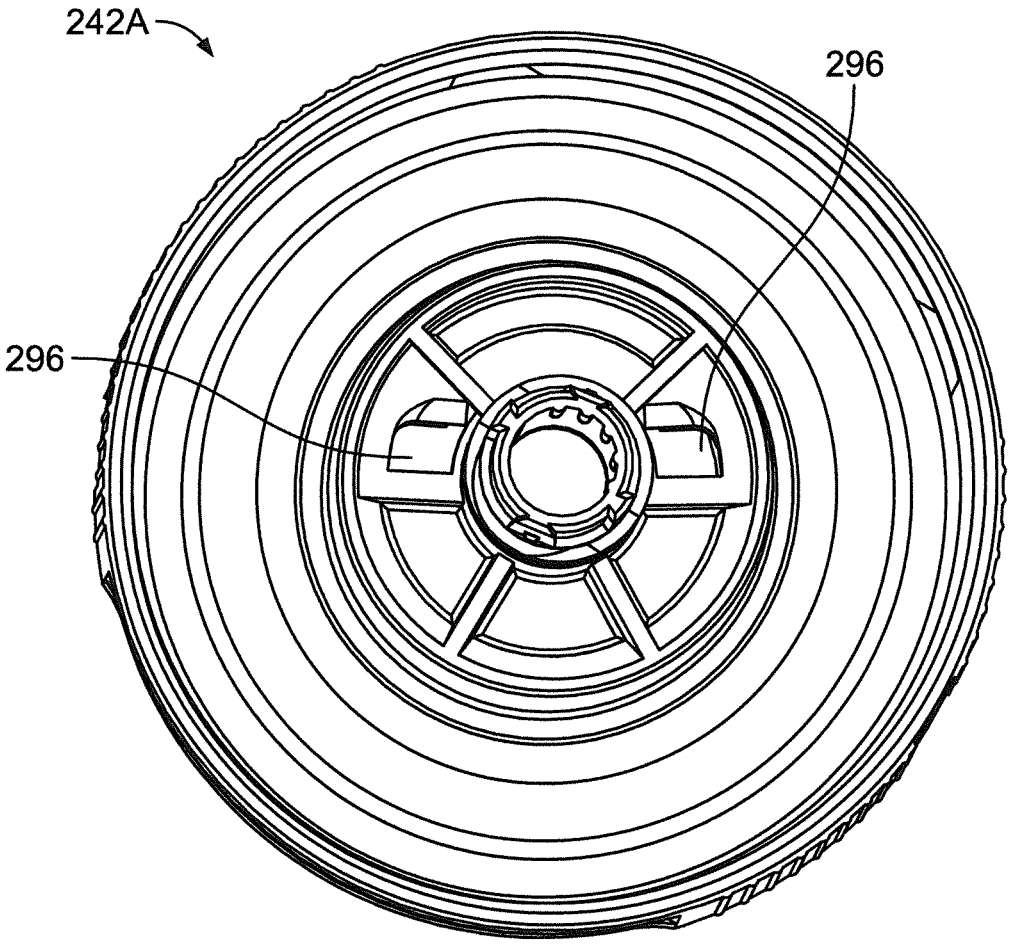
FIG. 23 is a bottom plan view of the unassembled nozzle housing and valve sleeve of FIG. 19 for side strip irrigation.
Figure 23:
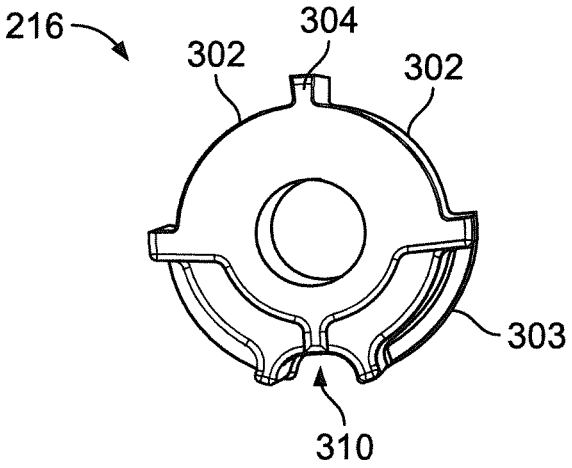

A third embodiment (nozzle 200) is shown in FIG. 19. In this third embodiment (like the second embodiment), the valve sleeve 216 is not rotatable, and the nozzle 200 is not adjustable between multiple strip settings. Again, the valve sleeve 216 preferably includes drive locks 294 that are received within recesses between teeth 26 of the deflector 12 to facilitate convenient installation of the nozzle 200. Further, in this form, the valve sleeve 216 (first body) and the nozzle housing 242 (second body) remain fixed relative to one another and define a specific strip irrigation configuration. In this form, it is contemplated that there are three separate distinct models of nozzle 200 with pattern templates 214 that produce three distinct strip irrigation patterns, i.e., a side strip pattern, a left strip pattern, and a right strip pattern. In this third embodiment, the components of the nozzle 200 are the same as those described above for the first and second embodiments, except for the valve sleeve 216 and nozzle housing 242.

The nozzle housing 242A and valve sleeve 216 are shown in FIGS. 20-23. The nozzle housing 242A has two arcuate cut-outs 294 disposed in its central hub 264. Each arcuate cut-out 294 of the nozzle housing 242A has a non-uniform width in order to create a generally rectangular irrigation pattern, as discussed further below. Each arcuate cut-out 294 has a relatively wide flow opening, or notch 296, at a distal end of the arcuate cut-out 294 (that extends completely through the nozzle housing 242A). A wall 298 divides the two arcuate cut-outs 294 with each cut-out extending about 90 degrees. Further, the proximal end of each arcuate cut-out 294 terminates in a recessed radial groove 300 that does not extend completely through the nozzle housing 242A. A recessed arcuate portion (or path) 299 of the arcuate cut-out 294 connects the notch 296 at the distal end to the radial groove 300 at the proximal end. Fluid enters the nozzle housing 242A at each notch 296 and then flows through each arcuate cut-out 294 to the valve sleeve 216. Fluid flowing through the notch 296 is the main flow that fills in relatively distant areas of the strip pattern, and fluid flowing through the radial groove 300 is low velocity flow that fills in closer areas of the strip patterns. Fluid flowing in one arcuate cut-out 294 is kept separate from fluid flowing through the other arcuate cut-out 294 by the wall 298.

The valve sleeve 216 has two indented arcuate surfaces 302 that are divided from one another by separator wall 304. As can be seen, the arcuate surface 302 are indented relative to an outer arcuate surface 303 of the valve sleeve 216. When the valve sleeve 216 is nested within the nozzle housing 242A, the two indented surfaces 302 and separator wall 304 cooperate with the nozzle housing 242A to define two discrete flow channels 306. Fluid flowing through each arcuate cut-out 294 of the nozzle housing 242A continues upwards through the two flow channels 306 of the valve sleeve 216 and then impacts the deflector 12. As can be seen, there are two distinct fluid streams that are kept separated from one another by the divider wall 298 (of the nozzle housing 242) and the separator wall 304 (of the valve sleeve 216). This separation helps ensure a matched precipitation rate for each half of the rectangular strip pattern.

The valve sleeve 216 is held in a fixed position within the nozzle housing 242A. More specifically, the nozzle housing 242A includes a boss 308 that acts as a key to fit in a recess 310 of the valve sleeve 216 to lock the valve sleeve 216 in place with respect to the nozzle housing 242A. In the side strip orientation, the two arcuate cut-outs 294 of the nozzle housing 242 are aligned with the two indented surfaces 302 of the valve sleeve 216 to define a roughly 180 degree pattern (such as can be seen from FIG. 21). In this orientation, the nozzle 200 irrigates a rectangular strip that extends to both sides of the nozzle (FIG. 9B), and in one form, the nozzle 200 may irrigate a 5 foot by 30 foot rectangle.

Figure 24:
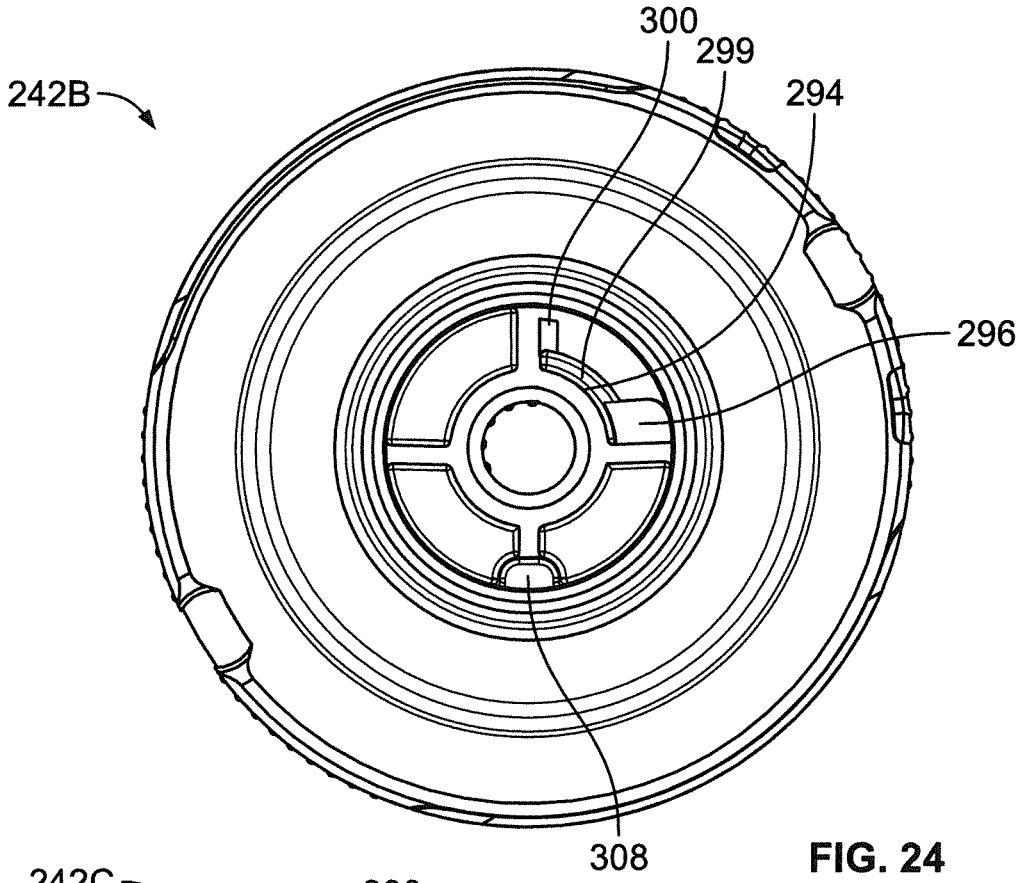
FIG. 24 is a top plan view of an alternative form of nozzle housing of the nozzle of FIG. 19 for right strip irrigation.
Figure 25:
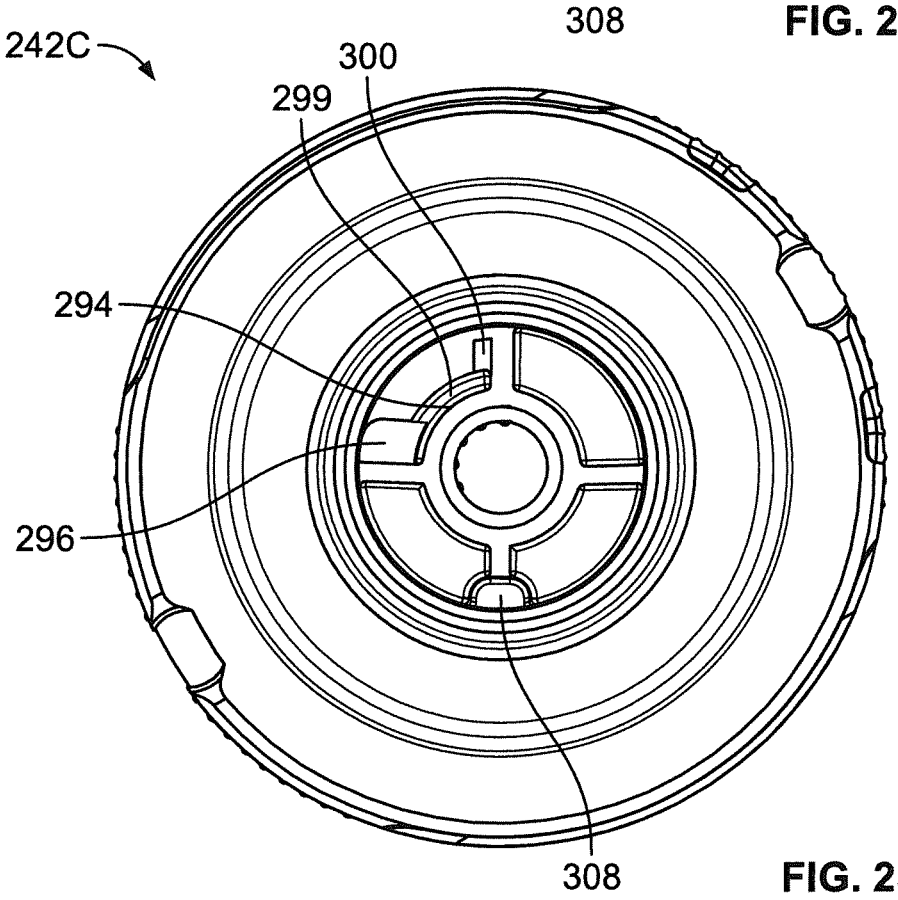
FIG. 25 is a top plan view of an alternative form of nozzle housing of the nozzle of FIG. 19 for left strip irrigation.

By selectively eliminating one of the two arcuate cut-outs 294, the nozzle 200 can be configured for two other rectangular irrigation patterns, i.e., left strip and right strip patterns, as described further below. In other words, there are three nozzle models where the arrangement of the arcuate cut-outs 294 is different to achieve different strip patterns. As shown in FIG. 24, in a right strip nozzle, the nozzle housing 242B has been modified to include only one arcuate cut-out 294, and the one cut-out 294 overlaps with one indented surface 302. In this right strip orientation, the nozzle irrigates a rectangular strip that extends to the right of the nozzle (FIG. 9C), and in one form, the nozzle irrigates a 5 foot by 15 foot rectangle. As shown in FIG. 25, in a left strip nozzle, the nozzle housing 242C has been modified to include only the other arcuate cut-out 294, and the different cut-out 294 overlaps with a different indented surface 302. In this left strip orientation, the nozzle irrigates a rectangular strip that extends to the left of the nozzle (FIG. 9A), which, in one form, may constitute a 5 foot by 15 foot rectangle. So, for right and left strip irrigation, the nozzle housing 242A has been modified to eliminate one of the arcuate cut-outs 294, and the valve sleeve 216 has not been modified.

It is also contemplated that the nozzle housing 242A might be used as a common nozzle housing to achieve left and right strip irrigation by shifting the orientation of valve sleeve 216 and nozzle housing 242A relative to one another. More specifically, it is contemplated that the nozzle housing 242A might be used but with the recess 310 of the valve sleeve 216 acting as a key re-positioned 90 degrees, i.e., clockwise or counterclockwise, so that the orientation of nozzle housing 242A to valve sleeve 216 is shifted 90 degrees. In other words, the nozzle housing 242A may be used to produce left or right strip patterns by fixing the orientation of the assembled nozzle housing 242A and valve sleeve 216 at either 90 degrees clockwise or counterclockwise from the side strip orientation shown in FIG. 20.

The structure of nozzle 200 preferably provides for a matched precipitation rate of the nozzle 200. In other words, the precipitation rate of the nozzle 200 is the same, regardless of whether the nozzle 200 is a left strip, right strip, or side strip nozzle 200. Generally, fluid flowing into the nozzle housing 242A is divided such that there are two separate, isolated flow paths through the nozzle housing 242 in the side strip nozzle 200, while only one of these flow paths is used in the nozzle housings 242B and 242C of the left and right strip nozzles 200.

As shown in FIG. 2, the nozzle 10 (as well as nozzles 100 and 200) also preferably include a radius control valve 400. The radius control valve 400 can be used to selectively set the fluid flowing through the nozzle 10 (and nozzles 100 and 200), for purposes of regulating the range of throw of the projected water streams. It is adapted for variable setting through use of a rotatable segment 402 located on an outer wall portion of the nozzle 10 (and nozzles 100 and 200). It functions as a valve that can be opened or closed to allow the flow of water through the nozzle 10. Also, a filter 404 is preferably located upstream of the radius control valve 400, so that it obstructs passage of sizable particulate and other debris that could otherwise damage the nozzle components or compromise desired efficacy of the nozzle 10 (and nozzles 100 and 200).

The radius control valve 400 allows the user to set the relative dimensions of the side, left, and right rectangular strips. In one preferred form, the nozzle 10 irrigates a 5 foot by 30 foot side strip area and a 5 foot by 15 foot left and right strip area, when the radius control valve 400 is fully open. The user may then adjust the valve 400 to reduce the throw radius, which decreases the size of the rectangular area being irrigated but maintains the proportionate sizes of the legs of the rectangle.

As shown in FIGS. 2-4B, the radius control valve structure preferably includes a nozzle collar 406 and a flow control member 408 for use with any of the nozzles, nozzle housings, and valve sleeves disclosed herein. The nozzle collar 406 is rotatable about the central axis of the nozzle 10 (and nozzles 100 and 200). It has an internal engagement surface 410 and engages the flow control member 408 so that rotation of the nozzle collar 406 results in rotation of the flow control member 408. The flow control member 408 also engages the nozzle housing 42/142/242/542 such that rotation of the flow control member 408 causes the member 408 to move in an axial direction, as described further below. In this manner, rotation of the nozzle collar 406 can be used to move the flow control member 408 helically in an axial direction closer to and further away from an inlet 412. When the flow control member 408 is moved closer to the inlet 412, the throw radius is reduced. The axial movement of the flow control member 408 towards the inlet 412 increasingly pinches the flow through the inlet 412. When the flow control member 408 is moved further away from the inlet 412, the throw radius is increased. This axial movement allows the user to adjust the effective throw radius of the nozzle 10 without disruption of the streams dispersed by the deflector 12.

As shown in FIGS. 2-4B, the nozzle collar 406 is preferably cylindrical in shape and includes an engagement surface 410, preferably a splined surface, on the interior of the cylinder. The nozzle collar 406 preferably also includes an outer wall 414 having an external grooved surface for gripping and rotation by a user. Water flowing through the inlet 412 passes through the interior of the cylinder and through the remainder of the nozzle body 17 to the deflector 12. Rotation of the outer wall 414 causes rotation of the entire nozzle collar 406.

Figure 3B:
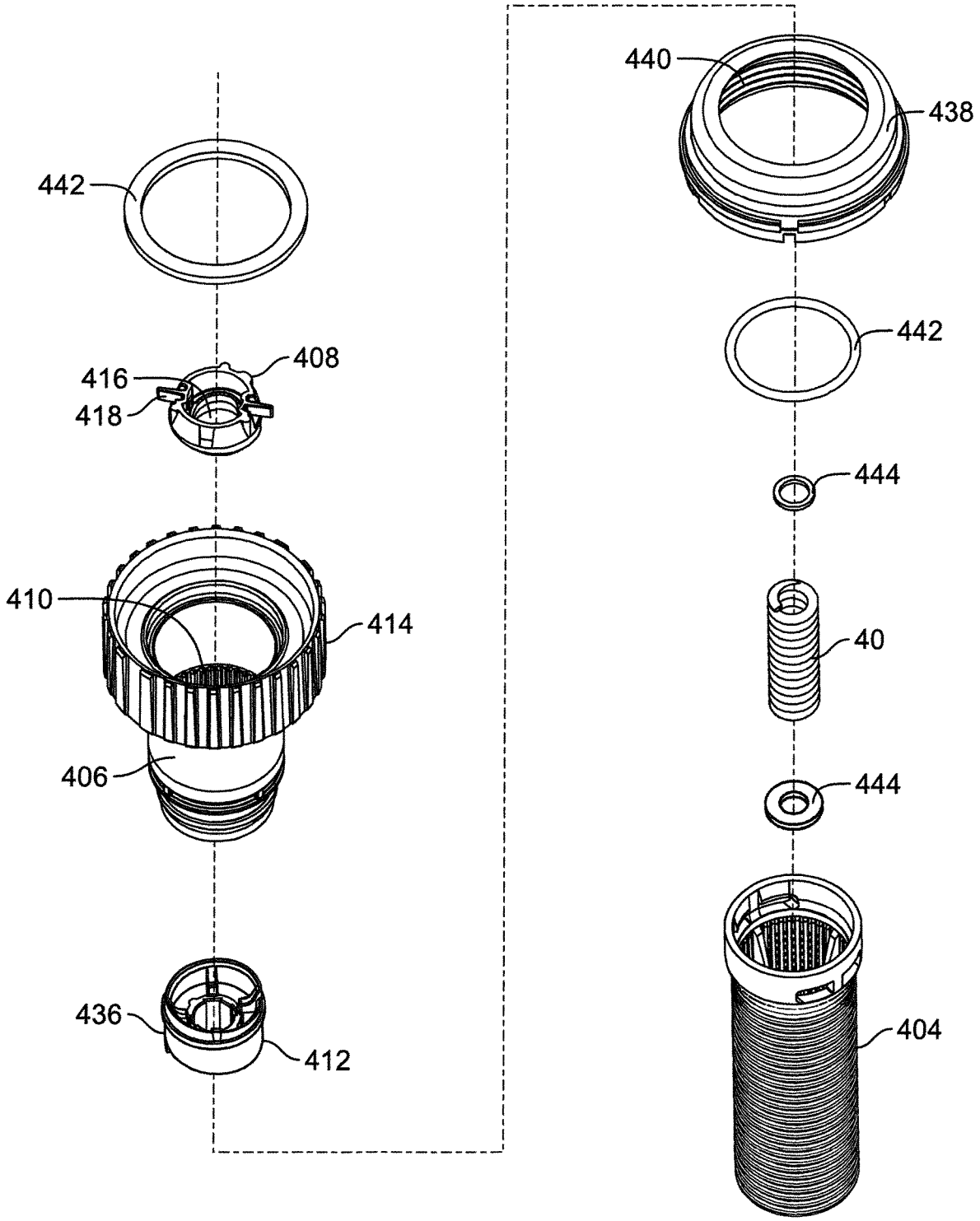
Figure 4B:
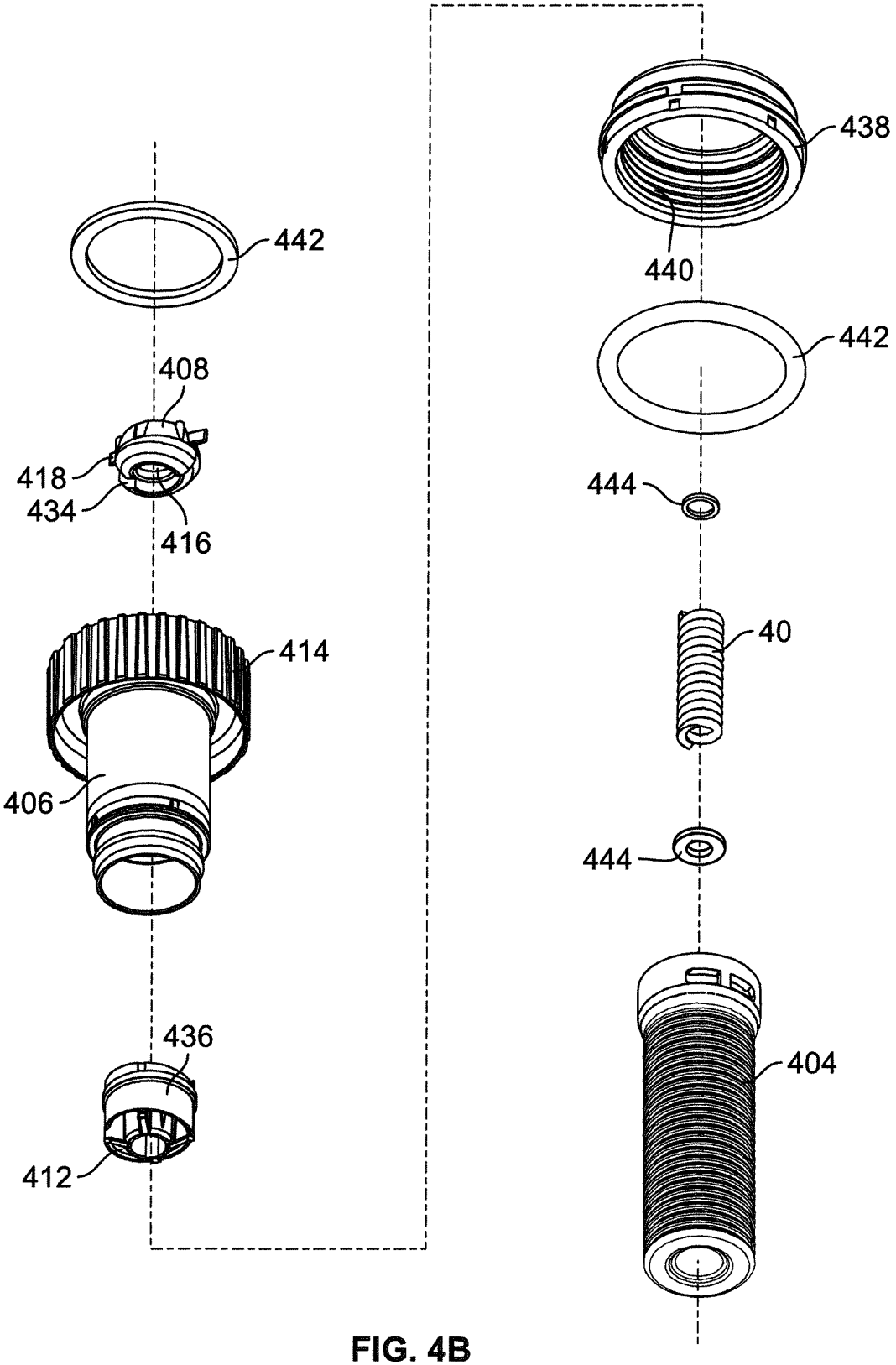

The nozzle collar 406 is coupled to the flow control member 408 (or throttle body). As shown in FIGS. 3B and 4B, the flow control member 408 is preferably in the form of a ring-shaped nut with a central hub defining a central bore 416. The flow control member 408 has an external surface with two thin tabs 418 extending radially outward for engagement with the corresponding internal splined surface 410 of the nozzle collar 406. The tabs 418 and internal splined surface 410 interlock such that rotation of the nozzle collar 406 causes rotation of the flow control member 408 about the central axis.

In turn, the flow control member 408 is coupled to the nozzle housing 42/142/242/542. More specifically, the flow control member 408 is internally threaded for engagement with an externally threaded hollow post 420 at the lower end of the nozzle housing 42/142/242/542. Rotation of the flow control member 408 causes it to move along the threading in an axial direction. In one preferred form, rotation of the flow control member 408 in a counterclockwise direction advances the member 408 towards the inlet 412 and away from the deflector 12. Conversely, rotation of the flow control member 408 in a clockwise direction causes the member 408 to move away from the inlet 412. Although threaded surfaces are shown in the preferred embodiment, it is contemplated that other engagement surfaces could be used to effect axial movement.

The nozzle housing 42/142/242/542 preferably includes an outer cylindrical wall 422 joined by spoke-like ribs 424 to an inner cylindrical wall 426. The inner cylindrical wall 426 preferably defines the bore 66 to accommodate insertion of the shaft 20 therein. The inside of the bore 66 is preferably splined to engage a splined surface 428 of the shaft 20 and fix the shaft 20 against rotation. The lower end forms the external threaded hollow post 420 for insertion in the bore 416 of the flow control member 408, as discussed above. The ribs 424 define flow passages 430 to allow fluid flow upwardly through the remainder of the nozzle 10.

In operation, a user may rotate the outer wall 414 of the nozzle collar 406 in a clockwise or counterclockwise direction. As shown in FIGS. 3A and 4A, the nozzle housing 42/142/242/542 preferably includes one or more cut-out portions 432 to define one or more access windows to allow rotation of the nozzle collar outer wall 414. Further, as shown in FIG. 2, the nozzle collar 406, flow control member 408, and nozzle housing 42/142/242/542 are oriented and spaced to allow the flow control member 408 to essentially block fluid flow through the inlet 412 or to allow a desired amount of fluid flow through the inlet 412. The flow control member 408 preferably has a helical bottom surface 434 for engagement with a valve seat 436 (preferably having a helical top surface).

Rotation in a counterclockwise direction results in helical movement of the flow control member 408 in an axial direction toward the inlet 412. Continued rotation results in the flow control member 408 advancing to the valve seat 436 formed at the inlet 412 for blocking fluid flow. The dimensions of the radial tabs 418 of the flow control member 408 and the splined internal surface 410 of the nozzle collar 406 are preferably selected to provide over-rotation protection. More specifically, the radial tabs 418 are sufficiently flexible such that they slip out of the splined recesses upon over-rotation. Once the inlet 412 is blocked, further rotation of the nozzle collar 406 causes slippage of the radial tabs 418, allowing the collar 406 to continue to rotate without corresponding rotation of the flow control member 408, which might otherwise cause potential damage to nozzle components.

Rotation in a clockwise direction causes the flow control member 408 to move axially away from the inlet 412. Continued rotation allows an increasing amount of fluid flow through the inlet 412, and the nozzle collar 406 may be rotated to the desired amount of fluid flow. When the valve is open, fluid flows through the nozzle 10 (and nozzles 100 and 200) along the following flow path: through the inlet 412, between the nozzle collar 406 and the flow control member 408, through the nozzle housing 42/142/242/542, through the valve sleeve 16/116/216, to the underside surface of the deflector 12, and radially outwardly from the deflector 12. It should be evident that the direction of rotation of the outer wall 414 for axial movement of the flow control member 408 can be easily reversed, i.e., from clockwise to counterclockwise or vice versa.

The nozzle 10 (and nozzles 100 and 200) also preferably include a nozzle base 438 of generally cylindrical shape with internal threading 440 for quick and easy thread-on mounting onto a threaded upper end of a riser with complementary threading (not shown). The nozzle base 438 and nozzle housing 42/142/242/542 are preferably attached to one another by welding, snap-fit, or other fastening method such that the nozzle housing 42/142/242/542 is stationary when the base 438 is threadedly mounted to a riser. The nozzle 10 (and nozzles 100 and 200) also preferably include seal members 442, such as o-rings, at various positions, as shown in FIG. 2, to reduce leakage. The nozzle 10 (and nozzles 100 and 200) also preferably includes retaining rings or washers 444 disposed at the top of valve sleeve 16 (preferably for engagement with shaft shoulder 44) and near the bottom end of the shaft 20 for retaining the spring 40.

The radius adjustment valve 400 and certain other components described herein are preferably similar to that described in U.S. Pat. Nos. 8,272,583 and 8,925,837, which are assigned to the assignee of the present application and are incorporated herein by reference in their entirety. Generally, in this preferred form, the user rotates a nozzle collar 406 to cause a throttle nut 408 to move axially toward and away from the valve seat 436 to adjust the throw radius. Although this type of radius adjustment valve 400 is described herein, it is contemplated that other types of radius adjustment valves may also be used.

It will be understood that various changes in the details, materials, and arrangements of parts and components which have been herein described and illustrated in order to explain the nature of the nozzle may be made by those skilled in the art within the principle and scope of the nozzle as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a deflector having an upstream surface contoured to deliver fluid radially outwardly therefrom to a coverage area;

a pattern template upstream of the deflector and defining a plurality of flow channels, the pattern template comprising:

a first body, and a second body including a recess and a curved sidewall defining at least part of the recess, the first body being nested within the recess and the plurality of flow channels being disposed within the curved sidewall defining at least part of the recess such that fluid flows in the plurality of flow channels in the space between the first body and the second body, the plurality of flow channels projecting outwardly into the second body at the curved sidewall and being separate and distinct flow channels formed in the curved sidewall at the recess;

wherein the plurality of flow channels directs fluid against the deflector and defines a rectangular coverage area;

wherein the plurality of flow channels comprises at least one set of flow channels with each set including at least a first flow channel and a second flow channel, the second flow channel contoured to deliver fluid a shorter distance than the first flow channel radially outwardly from the deflector;

wherein inlets of the first and second flow channels of each set are staggered at different upstream heights.

2. The nozzle of claim 1, wherein inlets of the first and second flow channels of each set are staggered in size such that the inlet of the first flow channel is larger than the inlet of the second flow channel.

3. The nozzle of claim 1, wherein each set of flow channels includes a third flow channel, the third flow channel contoured to deliver fluid an intermediate distance from the deflector relative to the first and second flow channels.

4. The nozzle of claim 3, wherein inlets of the first, second, and third flow channels of each set are staggered such that the inlet of the first flow channel is larger than the inlet of the second flow channel and the inlet of the second flow channel is smaller than the inlet of the third flow channel.

5. The nozzle of claim 1, wherein each of the flow channels is configured to fill in various parts of the rectangular coverage area such that the plurality of flow channels collectively fill in different parts of the rectangular coverage area.

6. The nozzle of claim 1, wherein at least one flow channel is angled relative to a radial line extending from a central axis of the nozzle through the at least one flow channel.

7. A nozzle comprising:

a deflector having an upstream surface contoured to deliver fluid radially outwardly therefrom to a coverage area;

a pattern template upstream of the deflector and defining a plurality of flow channels, the pattern template comprising:

a first body, and a second body including a recess and a curved wall defining at least part of the recess, the first body being nested within the recess and the plurality of flow channels being disposed within the curved wall defining at least part of the recess such that fluid flows in the plurality of flow channels in the space between the first body and the second body;

wherein the plurality of flow channels directs fluid against the deflector and defines a rectangular coverage area;

wherein the plurality of flow channels comprises at least one set of flow channels with each set including at least a first flow channel and a second flow channel, the second flow channel contoured to deliver fluid a shorter distance than the first flow channel radially outwardly from the deflector;

wherein the first body and the second body are fixed against rotation relative to one another.

8. The nozzle of claim 7, wherein the first body includes a key configured to be received within the recess of the second body to fix the first and second bodies against rotation relative to one another.

9. The nozzle of claim 7, further comprising at least one notch on an upstream surface of the first body, the at least one notch aligned with the first flow channel of each set.

10. The nozzle of claim 7, wherein the second body comprises a sealing surface for engagement with the first body, the sealing surface restricting flow through the pattern template to one or more of the plurality of flow channels.

* * * * *